US007185975B2

(12) United States Patent
Morita

(10) Patent No.: US 7,185,975 B2
(45) Date of Patent: Mar. 6, 2007

(54) INK DETECTING APPARATUS AND INK PACKAGE

(75) Inventor: Yoshitsugu Morita, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 264 days.

(21) Appl. No.: 10/773,178

(22) Filed: Feb. 9, 2004

(65) Prior Publication Data

US 2004/0178106 A1 Sep. 16, 2004

(30) Foreign Application Priority Data

Mar. 11, 2003 (JP) ..... 2003-065574
Mar. 27, 2003 (JP) ..... 2003-088178

(51) Int. Cl.
*B41J 2/175* (2006.01)

(52) U.S. Cl. ..... 347/86; 347/85

(58) Field of Classification Search ..... 347/85, 347/86

See application file for complete search history.

(56) References Cited

U.S. PATENT DOCUMENTS

| | | | | |
|---|---|---|---|---|
| 4,568,954 | A * | 2/1986 | Rosback | 347/86 |
| 4,636,814 | A | 1/1987 | Terasawa | |
| 4,760,409 | A | 7/1988 | Kiyohara et al. | |
| 4,901,094 | A | 2/1990 | Iwagami et al. | |
| 6,164,744 | A | 12/2000 | Froger et al. | |
| 6,276,788 | B1 | 8/2001 | Hilton | |
| 6,280,024 | B1 * | 8/2001 | Miyazawa et al. | 347/86 |
| 2002/0001009 | A1 * | 1/2002 | Gasvoda et al. | 347/19 |
| 2004/0032470 | A1 * | 2/2004 | Perkins et al. | 347/86 |

FOREIGN PATENT DOCUMENTS

| | | | |
|---|---|---|---|
| CN | 1259090 | A | 7/2000 |
| DE | 34 05 165 | A | 8/1985 |
| DE | 34 05 165 | A1 | 8/1985 |
| DE | 36 44 095 | A1 | 7/1988 |
| EP | 0 184 456 | A2 | 6/1986 |
| EP | 1 125 748 | A1 | 8/2001 |
| JP | A 59-194856 | | 11/1984 |
| JP | 60131248 | A * | 7/1985 |
| JP | A 60 131248 | | 7/1985 |
| JP | A 60-131248 | | 7/1985 |
| JP | B2 3-55313 | | 8/1991 |
| JP | 06039161 | B * | 2/1994 |
| JP | B2 6-39161 | | 5/1994 |
| JP | B2 7-25166 | | 3/1995 |
| JP | A 10-109426 | | 4/1998 |
| JP | A 11-78045 | | 3/1999 |
| WO | WO 98/55323 | | 12/1995 |

* cited by examiner

*Primary Examiner*—Manish S. Shah
*Assistant Examiner*—Laura E. Martin
(74) *Attorney, Agent, or Firm*—Oliff & Berridge, PLC

(57) ABSTRACT

An ink package including: an ink bag including a pair of flexible walls which are opposed to each other and accommodating ink, and an ink delivering portion having a passage through which an interior space and an exterior space of the ink bag are held in communication for delivering the ink in the ink bag to the exterior space; wherein the ink delivering portion includes a fixing portion which is fixed to one of opposite ends of the ink bag, and an extending portion which is formed adjacent to the fixing portion so as to extend therefrom into the interior space of the ink bag, the extending portion having a cross sectional area which gradually decreases in a direction from the above-indicated one of the opposite ends of the ink bag toward the other end thereof.

32 Claims, 12 Drawing Sheets

INK DETECTING APPARATUS AND INK PACKAGE

The present application is based on Japanese Patent Application Nos. 2003-65574 filed on Mar. 11, 2003, and 2003-88178 filed on Mar. 27, 2003, the contents of which are incorporated herein by reference.

BACKGROUND OF THE INVENTION

1. Field of the Invention

The present invention relates in general to an ink package including an ink bag which accommodates ink and which is formed of a flexible material, and an ink detecting apparatus. In particular, the present invention relates to an ink package which permits the ink in the ink bag to be effectively consumed, and an ink detecting apparatus which detects, with high accuracy, so-called "a near empty state" of the ink package wherein the ink in the ink bag will run out in the near future, more specifically, the ink in the ink bag has been reduced to a predetermined amount which is larger, by a predetermined amount, than an empty state of the ink (in which a printing operation is impossible) or an amount of the ink in which a printing operation should be inhibited. The invention also relates to an ink package having a structure that permits the near empty state to be detected with high accuracy.

2. Discussion of Related Art

There is conventionally known an ink-jet recording apparatus adapted to introduce ink accommodated an ink container into a printing head, and eject, toward a recording medium, the ink through a plurality of nozzles formed in the printing head by activating the nozzles in accordance with recording patterns, so that a desired image is formed on the recording medium. On the ink-jet recording apparatus, there is mounted an ink cartridge which includes an ink package accommodating ink.

For instance, JP-A-11-78045 discloses an ink cartridge 3 which includes an ink package 11. The disclosed ink package 11 is in the form of a fluid-tightly closed bag formed of a flexible sheet-like resin material. The ink package 11 is accommodated in a rigid cartridge casing 12. The ink package 11 has opposite major surfaces 11*a*, 11*b* which are welded at a peripheral portion 11 so as to provide the closed bag. An ink supply member 6 is sandwiched between the opposite surfaces 11*a*, 11*b* at one of opposite ends of the closed bag. The ink supply member 6 includes a rubber member 14 which is pierced with a connecting member 5 in the form of a hollow needle to extract the ink from the ink package 11. When the rubber member 14 is pierced with the connecting member 5, the interior space and the exterior space of the ink package 11 is brought into communication with each other, so that the ink in the ink package 11 is supplied to a printing head 2.

In the disclosed ink package 11, one major surface 11*a* is bonded and fixed to a flat inner surface 12*a* of the cartridge casing 12. In the operation of the ink-jet recording apparatus, the ink is ejected from the printing head 2. With a decrease in the ink in the ink package 11 during the operation of the ink-jet recording apparatus, the other major surface 11*b* of the ink package 11 is deformed in a direction toward the one major surface 11*a* which is fixed to the flat inner surface 12*a* of the cartridge casing 12. In a state in which the ink in the ink package 11 is substantially consumed, the ink package 11 is in its contracted state in which the opposite major surfaces 11*a*, 11*b* are held in close contact with each other.

In the disclosed ink package 11, the ink supply member 6 is interposed between the opposite surfaces 11*a*, 11*b* such that its inner surface located within the ink package 11 is substantially perpendicular to the opposite surfaces 11*a*, 11*b* of the closed bag. When the ink in the ink package 11 has been substantially consumed and the opposite surfaces 11*a*, 11*b* are held in close contact with each other, there is formed a spacing between the two surfaces 11*a*, 11*b* in the vicinity of the inner surface of the ink supply member 6, and the ink undesirably remains in the spacing.

The ink remaining in the spacing described above is left unused, so that the ink in the ink package 11 cannot be used up, deteriorating the efficiency of use of the ink.

There is also known an ink-jet recording apparatus adapted to detect the near empty state of an ink bag installed on the apparatus. For instance, JP-B-6-39161 discloses such an ink-jet recording apparatus adapted to detect the near empty state based on a resistance value between two electrodes which are disposed at one and the other of opposite ends of a flat ink bag such that the two electrodes are opposed to each other. The flat ink bag is disposed in a casing in a horizontal posture such that its opposite flat major surfaces of the ink bag extend in the horizontal direction. In the disclosed apparatus, one of the two electrodes disposed at one of the opposite ends of the ink bag is a hollow ink-extracting needle which extracts ink from the ink bag and the other of the two electrodes is disposed at the other end of the ink bag such that the other electrode is opposed to the hollow needle which is inserted into the ink bag. The ink in the ink bag is consumed during operation of the ink-jet recording apparatus. When the amount of the ink remaining in the ink bag becomes small, the opposite major surfaces (the upper surface and the lower surface) of the ink bag are brought into contact with each other at substantially central portions thereof, whereby the resistance value between the two electrodes is increased. The disclosed apparatus detects or determines the near empty state based on the change of the resistance value.

JP-A-60-131248 discloses an ink-jet recording apparatus adapted to detect the near empty state by obtaining the resistance value between two electrodes which are disposed in parallel with each other and which protrude from one end of the ink bag into the interior space of the ink bag. In the disclosed apparatus, the two electrodes which have respective different lengths and which are covered with insulating tubes except leading end portions thereof are disposed in the ink bag filled with ink, such that the two electrodes are parallel with each other. The ink in the ink bag is consumed in the operation of the ink-jet recording apparatus. The disclosed apparatus is arranged to detect the near empty state at an earlier timing, by obtaining gradual changes of the resistance value between the two electrodes, based on the cross sectional shape of the ink in the ink bag which changes with a decrease in the amount of the ink remaining in the ink bag.

In the ink-jet recording apparatus disclosed in JP-B-6-39161 and adapted to detect the resistance value between the two electrodes which are disposed at one and the other of the opposite ends of the ink bag such that the two electrodes are opposed to each other, the near empty state is detected when the upper surface and the lower surface of the ink bag are brought into contact with each other at the substantially central portions thereof. In this arrangement, when the near empty state is detected, the ink remains at portions of the ink bag in the vicinity of the two electrodes, so that the ink remaining at the portions are undesirably left unused. Thus, the ink cannot be effectively consumed in the disclosed ink-jet recording apparatus.

In the ink-jet recording apparatus disclosed in JP-A-60-131248 and adapted to detect the resistance value between the two electrodes which are disposed in parallel with each other and which protrude from one end of the ink bag, the ink remains only at the above-indicated one end of the ink bag with a decrease in the remaining amount of the ink. However, the apparatus obtains the gradual change of the resistance value with the decrease in the remaining amount of the ink, so that there may a possibility of erroneously detecting or determining the near empty state.

SUMMARY OF THE INVENTION

The present invention was developed in the light of the situations described above. It is therefore a first object of the present invention to provide an ink package having an ink bag which accommodates ink and which is formed of a flexible material, the ink package having a structure that permits the ink in the ink bag to be effectively consumed.

It is a second object of the present invention to provide an ink detecting device which is capable of detecting the near empty state with high accuracy.

It is a third object of the present invention to provide an ink package having a structure that permits the near empty state to be detected with high accuracy.

The objects indicated above may be achieved according to a first aspect of the present invention, which provides an ink package comprising: an ink bag including a pair of flexible walls which are opposed to each other and accommodating ink; and an ink delivering portion having a passage through which an interior space and an exterior space of the ink bag are held in communication for delivering the ink in the ink bag to the exterior space, wherein the ink delivering portion includes a fixing portion which is fixed to one of opposite ends of the ink bag, and an extending portion which is formed adjacent to the fixing portion so as to extend therefrom into the interior space of the ink bag, the extending portion having a cross sectional area which gradually decreases in a first direction from the one of the opposite ends of the ink bag toward the other end thereof.

In the ink package constructed according to the above-indicated first aspect of the invention, the ink accommodated in the ink bag is delivered through the passage formed in the ink delivering portion. The ink bag contracts by an amount corresponding to the volume of the ink delivered therefrom, and the pair of flexible walls are brought into close contact with the extending portion in a final contracted state of the ink bag. Owing to the provision of the extending portion, the interior space of the ink bag in which the ink remains unless the ink delivering portion has the extending portion can be advantageously reduced or substantially eliminated, so that the amount of the ink remaining in the ink bag can be accordingly reduced, whereby the ink in the ink bag can be used with high efficiency.

The objects indicated above may also be achieved according to a second aspect of the invention, which provides an ink detecting apparatus which detects ink in an ink package that includes an ink bag accommodating ink and an ink delivering portion through which the ink in the ink bag is delivered from the ink bag, wherein the ink detecting apparatus comprises: a pair of electrodes provided to be held at one of opposite ends of the ink bag to electrically conduct with the ink in the ink bag; a hollow insulating member provided for one of the pair of electrodes to extend in a direction from the above-indicated one of opposite ends of the ink bag toward the other end thereof, the ink in the ink bag reaching the above-indicated one of the pair of electrodes through the hollow insulating member; and an electric characteristics detecting device which detects electric characteristics between the pair of electrodes.

In the ink detecting apparatus according to the second aspect of the invention, the hollow insulating member extends in the direction from the above-indicated one of opposite ends of the ink bag toward the other end thereof. The detecting apparatus is arranged to detect the near empty state of the ink bag when a value indicative of the electric characteristics detected by the electric characteristics detecting device is outside a predetermined range. For instance, the ink detecting apparatus detects the near empty state when a resistance value between the pair of electrodes is larger than a predetermined value or when a current value between the pair of electrodes is smaller than a predetermined value. In the present arrangement, the near empty state can be detected with high stability before the ink in the ink bag is reduced to an amount that makes a printing operation impossible.

In one preferred form of the second aspect of the invention, the ink bag includes a pair of walls which are opposed to each other and which are flexible in a direction in which the pair of walls contact each other with a decrease in an amount of the ink in the ink bag, the ink bag having a contact portion in which the walls contact each other in a state in which the amount of ink in the ink bag is reduced to a predetermined minimum value after the ink has been used under an ordinary recommended condition, and a non-contact portion in which the walls do not contact in the above-indicated state and in which the ink remains, the hollow insulating member extending in the direction from the above-indicated one of opposite ends of the ink bag toward the other end thereof beyond a boundary between the contact portion and the non-contact portion.

In the above-described preferred form, the hollow insulating member extends beyond the boundary between the above-indicated contact portion and the non-contact portion. According to this arrangement, the ink in the ink bag can be used with high efficiency until the amount of the ink is reduced to a level close to the predetermined minimum value, i.e., to a level close to the amount of the ink remaining in the non-contact portion of the ink bag. Further, the present ink detecting apparatus detects the change in the electric characteristics of the ink at a local portion of the ink bag between the open end of the hollow insulating member and the contact portion of the ink bag in which the pair of walls are held in contact with each other. Accordingly, the ink can be used with higher efficiency in the present arrangement than in the conventional arrangement in which a pair of electrodes are spaced apart from each other such that the electrodes are disposed at one and the other of opposite ends of an ink bag and electric characteristics are detected between the electrodes disposed as described above.

The arrangement according to the second aspect may be modified such that it includes the extending portion described above with respect to the first aspect. In this case, the features of the extending portion of the first aspect may be employed in the arrangement according to the second aspect.

Where the arrangement according to the second aspect is modified such that it includes the extending portion described above with respect to the first aspect, the hollow cylindrical portion extends from the extending portion toward the interior space of the ink bag, whereby the near empty state can be detected with high stability before the amount of the ink in the ink bag is reduced to a level that inhibits the printing operation. Further, in this arrangement, as described above with respect to the first aspect, the extending portion fills the interior space of the ink bag in which the ink remains unless the ink delivering portion has the extending portion, so that this arrangement makes it possible to consume the ink which would remain in the interior space of the ink bag if the extending portion were not provided can be accordingly reduced, in other words, the ink in the ink bag can be substantially used up with high efficiency.

The objects indicated above may be achieved according to a third aspect of the invention, which provides an ink package comprising: an ink bag accommodating ink and including a pair of walls which are opposed to each other and which are flexible in a direction in which the pair of walls contact each other with a decrease in an amount of the ink in the ink bag; an ink delivering portion which is provided at one of opposite ends of the walls and is provided for supporting a pair of electrodes such that the pair of electrodes electrically conduct with the ink in the ink bag; and a hollow insulating member which extends in a direction from the above-indicated one of opposite ends of the walls toward the other end thereof, and has a passage which communicates with one of the pair of electrodes and the ink within the ink bag at opposite ends thereof, respectively.

The ink package constructed according to this aspect is used together with an ink supply apparatus which includes an electric characteristics detecting device which detects electric characteristics between the pair of electrodes. According to this arrangement, the near empty state of the ink package can be detected with high stability based on the electric characteristics detected between the pair of electrodes before the ink in the ink bag is reduced to an amount that makes a printing operation impossible.

In one preferred form of the third aspect of the invention, the ink bag has a contact portion in which the walls contact each other in a state in which the amount of ink in the ink bag is reduced to a predetermined minimum value after the ink has been used under an ordinary recommended condition, and a non-contact portion in which the walls do not contact in the above-indicated state and in which the ink remains, the hollow insulating member extending in the direction from the above-indicated one of the opposite ends of the walls toward the other end beyond a boundary between the contact portion and the non-contact portion.

According to this arrangement, the ink in the ink bag can be used with high efficiency until the amount of the ink is reduced to a level close to the predetermined minimum value, i.e., to a level close to the amount of the ink remaining in the non-contact portion of the ink bag.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIGS. 2A–2D are views showing the ink package of FIG. 1, wherein FIG. 2A is a front elevational view, FIG. 2B is a side elevational view, FIG. 2C is an elevational view in cross section taken along line 2—2 of FIG. 2B, and FIG. 2D is a back elevational view;

FIGS. 3A–3C are views showing an ink package constructed according to a second embodiment of the invention, wherein FIG. 3A is a front elevational view, FIG. 3B is a side elevational view, and FIG. 3C is an elevational view in cross section taken along line 3—3 of FIG. 3B;

FIGS. 7A–7D are views showing the ink package of FIG. 6, wherein FIG. 7A is a front elevational view, FIG. 7B is a side elevational view, FIG. 7C is an elevational view in cross section taken along line 7—7 of FIG. 7B, and FIG. 7D is an elevational view in cross section of a spout of the ink package;

FIGS. 10A–10D are views showing an ink package constructed according to a fourth embodiment of the invention, wherein FIG. 10A is a front elevational view, FIG. 10B is a side elevational view, FIG. 10C is an elevational view in cross section taken along line 10—10 of FIG. 10B, and FIG. 10D is an elevational view in cross section of a spout of the ink package;

DETAILED DESCRIPTION OF THE PREFERRED EMBODIMENTS

Figure 1:
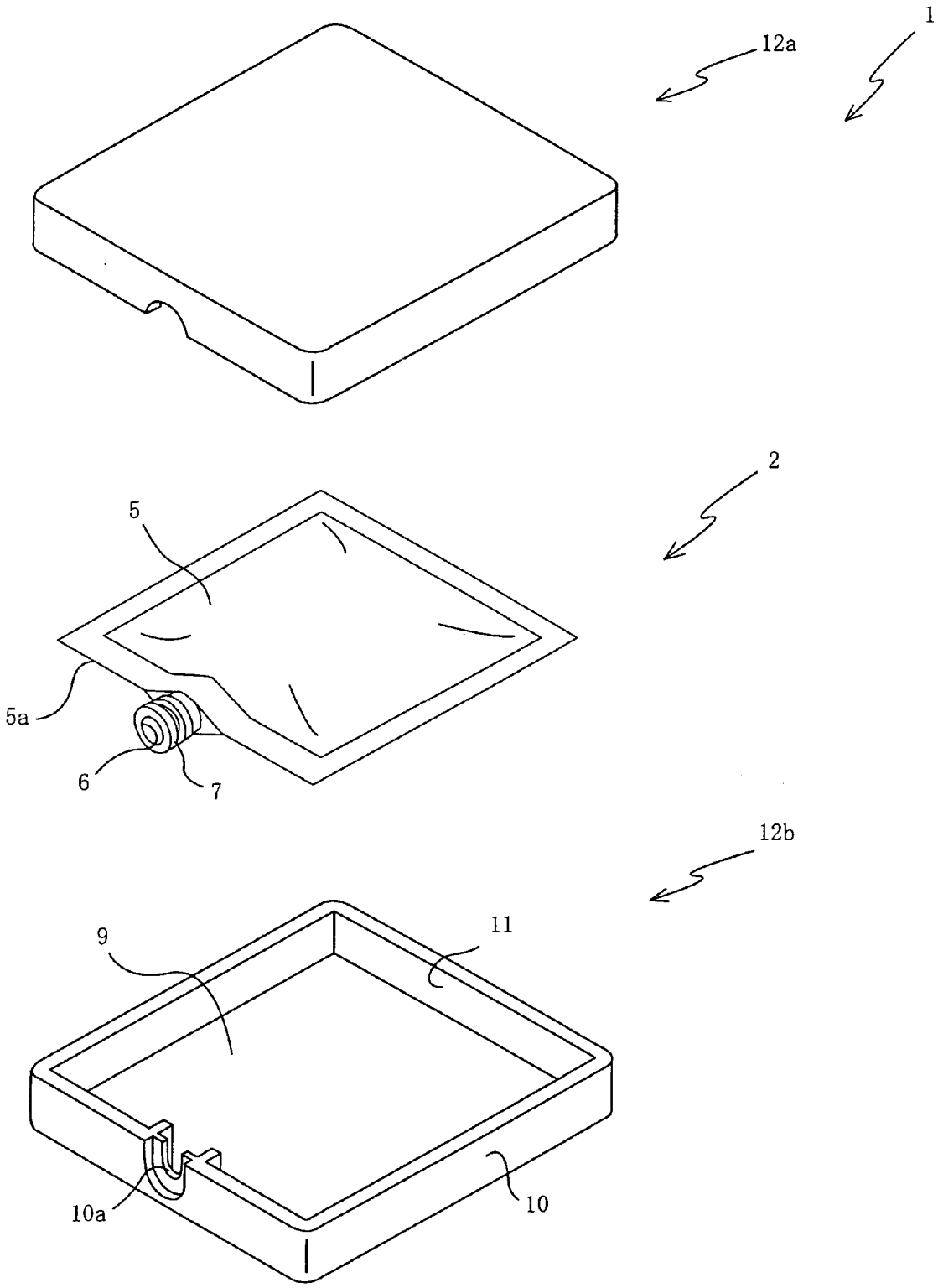
FIG. 1 is an exploded perspective view of an ink cartridge including an ink package and a casing constructed according to a first embodiment of the invention.

Referring to the drawings, there will be described preferred embodiments of the present invention.

Referring first to FIG. 1 of the exploded perspective view, there is shown an ink cartridge 1 which includes an in package 2 constructed according to a first embodiment of the present invention.

The ink cartridge 1 is an ink container which is installed on an ink-jet printer, for instance, and which stores ink that is supplied to a printing head of the ink-jet printer. As shown in FIG. 1, the ink cartridge 1 includes the ink package 2 in which the ink is accommodated and a casing 12 which is a generally flat, rectangular parallelopiped.

The casing 12 which accommodates the ink package 2 consists of an upper member 12*a* and a lower member 12*b*, which have substantially the same construction. Each of the upper and lower members 12*a*, 12*b* has a bottom wall 9, and four side walls 10 extending from respective four side edges of the bottom wall 9. The upper and lower members 12*a*, 12*b* are butted together at the end faces of the four side walls 10, so as to define an interior space 11 in which the ink package 2 is accommodated such that the opposite major surfaces of the ink package 2 in a generally flattened shape are opposed to the opposed bottom walls 9.

The bottom wall 9 of each of the upper and lower members 12*a*, 12*b* of the casing 12 has an inner surface which is substantially equal in size with the opposite major surfaces of the ink package 2. One of the four side walls 10 of each of the upper and lower members 12*a*, 12*b* has a cutout 10*a*, so that the cutouts 10*a* of the two members 12*a*, 12*b* cooperate to define a substantially circular aperture in which a spout 7 of the ink package 2 as an ink delivering portion is fixedly fitted. With the spout 7 being fitted in the aperture, the ink package 2 is fixedly accommodated in the casing 12. In this state, a plug 8 (FIGS. 2A and 2C) which is press-fitted within a passage 6 of the spout 7 is accessible through the aperture formed through the corresponding side walls 10 of the upper and lower members 12*a*, 12*b* of the casing 12.

The ink package 2 includes an ink bag 5 which fluid-tightly accommodates ink, and the spout 7 through which an interior space and an exterior space of the ink bag 5 are held in communication with each other. The ink bag 5 is formed from two flexible sheets each in the form of a laminar structure consisting of a plurality of films superposed on each other. The two sheets are superposed on each -other and welded together along their peripheries, except a non-welded portion of the periphery of each sheet, such that the two sheets are formed into the ink bag 5 having an opening 5*a* corresponding to the above-indicated non-welded portion, as shown in FIG. 1. In other words, one of lengthwise opposite ends 5*c* of the ink bag 5 which is opposed to the opening 5*a*, widthwise opposite ends 5*b* are welded together to form the ink bag 5. The ink bag 5 is filled with deaerated or degassed ink. The spout 7 is attached to the opening 5*a* of the ink bag 5. In the ink package 2 constructed as described above, the two sheets are symmetrical with respect to a plane including a welded surface at which the two sheets are welded together, and the spout 7 is also symmetrical with respect to that plane.

Each of the two sheets used for the ink bag 5 is a laminar structure consisting of an intermediate layer of an aluminum alloy; a first adhesive layer formed on one of opposite surfaces of the aluminum alloy intermediate layer; an outer layer of nylon formed on the first adhesive layer; a second adhesive layer formed on the other surface of the aluminum alloy intermediate layer; a layer of polyethylene terephthalate (PET) formed on the second adhesive layer; a third adhesive layer formed on the PET layer; and an inner layer of polypropylene formed on the third adhesive layer. The ink bag 5 formed from the laminar sheets described above has a high degree of durability. In particular, the inner layer of polypropylene enables the ink bag 5 to exhibit a high degree of resistance to the ink contained in the ink bag 5, while the aluminum alloy intermediate layer prevents permeation of gases through the ink bag 5, for thereby preventing deterioration of the degree of deaeration of the ink.

One of opposite ends of the spout 7 protrudes from the ink bag 5 and the other end is inserted within the ink bag 5. The spout 7 has a passage 6 formed therethrough for permitting the ink in the ink bag 5 to be delivered therefrom. The spout 7 is arranged such that a closure member in the form of the plug 8 described above is press-fitted in the passage 6, so as to close the passage 6, that is, to fluid-tightly isolate the interior and exterior spaces of the ink bag 5. The structure of the spout 7 will be explained in greater detail.

The spout 7 is formed of a material whose major component is polypropylene having a high degree of resistance to the ink. Namely, the major component of the material of the spout 7 is the same as the material of the inner layer of the ink bag 5, so that a plurality of ribs 7*d* (FIG. 2C) formed integrally on the outer circumferential surface of the spout 7 can be firmly welded and fixed to the inner surface of the opening 5*a* of the ink bag, so as to prevent a flow of gases into the ink bag 5 through the welded portion between the ink bag 5 and the spout 7, for thereby preventing deterioration of the degree of deaeration of the ink within the ink bag 5.

The plug 8 which is press-fitted in one of opposite end portions of the passage 6 of the spout 7, i.e., an outer end portion 6*c* of the passage 6, is formed of a butyl rubber or similar material having a high degree of elasticity or resiliency that assures a sufficient degree of fluid tightness of the ink bag 5 even after a connecting portion of an ink-extracting needle (not shown) that has pierced the plug 8 is removed from the plug 8. The connecting portion of the needle that has pierced the plug 8 is held in contact with the ink in the passage 6 of the spout 7, so that the ink in the ink bag 5 is delivered to the exterior space of the ink package 2. The ink bag 5 contracts, namely, the volume of the ink bag 5 is reduced by an amount corresponding to that of the ink which has been delivered from the ink bag 5.

Figures 2A, 2B, 2C, 2D:
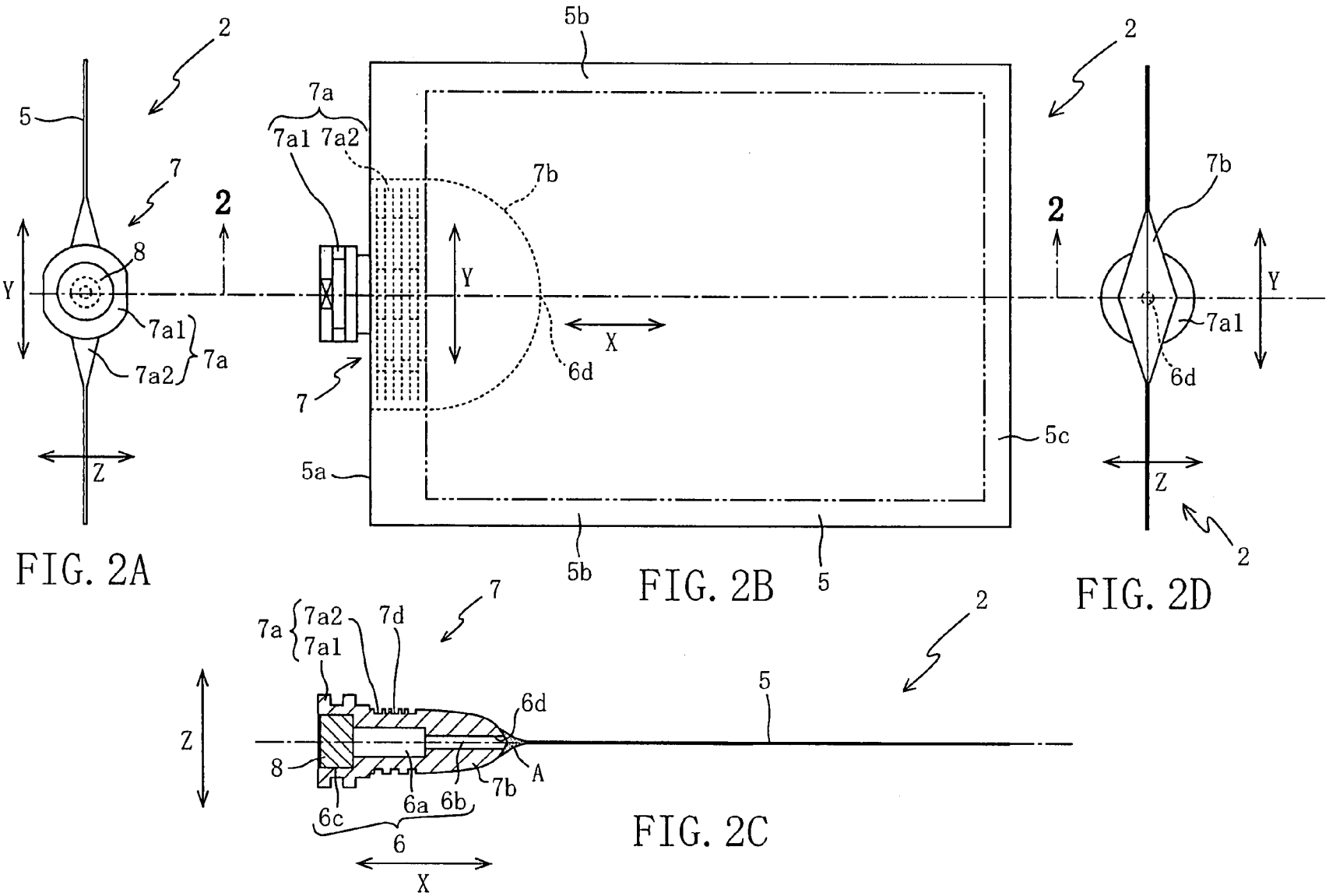

Referring next to FIGS. 2A–2D, there will be described in detail the structure of the ink package 2. FIG. 2A is a front elevational view of the ink package 2, as seen in a direction in which the spout 7 is inserted into the ink bag 5. FIG. 2B is a side elevational view, FIG. 2C is an elevational view in cross section taken along line 2—2 of FIG. 2B, and FIG. 2D is a back elevational view of the ink package 2.

The ink package 2 shown in FIGS. 2A–2D is in a state in which the ink in the ink bag 5 has been substantially consumed, in other words, in a final contracted state of the ink bag 5. The dimension of the spout 7 as measured in a "Z"-direction shown in FIGS. 2A, 2C and 2D (in which the two sheets of the ink bag 5 are opposed to each other) is hereinafter referred to a thickness of the spout 7.

Described in detail, the spout 7 includes a proximal portion 7*a* which is fixed to the ink bag 5 and an extending portion 7*b* which protrudes from the proximal portion 7*a* into the interior space of the ink bag 5.

As shown in FIG. 2B, the proximal portion 7*a* of the spout 7 includes a protruding portion 7*a*1 which protrudes outwardly from the opening 5*a* of the ink bag 5 in a direction away from the ink bag 5, a fixing portion 7*a*2 which is fixed to the inner surface of the ink bag 5 at one of the lengthwise opposite ends of the ink bag 5 (at one of opposite ends of the ink bag 5 as seen in an "X"-direction shown in FIG. 2B). As shown in FIG. 2A, the protruding portion 7*a*1 has a substantially cylindrical shape, and the plug 8 described above is accommodated in the protruding portion 7*a*1. The fixing portion 7*a*2 is formed adjacent to the protruding portion 7*a*1 on one of opposite ends thereof nearer to the ink bag 5.

The fixing portion 7*a*2 formed adjacent to the protruding portion 7*a*1 as described above is fixed, by welding, at its outer circumferential surface to the inner surface of the opening 5*a* of the ink bag 5. In other words, the fixing portion 7*a*2 is sandwiched by and between the opposite major surfaces of the ink bag 5. As described above, the outer circumferential surface of the fixing portion 7*a*2 which is to be contact the inner surface of the opening 5*a* is provided with the ribs 7*d*, so that the spout 7 is welded and fixed to the ink bag 5 with high stability owing to the ribs 7*d*.

As shown in the side elevational view of FIG. 2B, the fixing portion 7*a*2 is symmetrical with respect to a plane which includes the centerline of the protruding portion 7*a*1, in other words, the longitudinal opposite ends of the fixing portion 7*a*2 which extend toward the widthwise opposite ends 5*b*, 5*b* of the ink bag 5 are spaced apart by the same distance from the centerline of the protruding portion 7*a*1. The fixing portion 7*a*2 has a rectangular shape as viewed in a plane parallel to the opposite major surfaces of the ink bag 5, i.e., as viewed in FIG. 2B. As shown in FIG. 2A, the thickness of the fixing portion 7*a*2 gradually decreases toward opposite two directions "Y" (as indicated by two arrows in FIG. 2A), i.e., toward widthwise opposite ends 5*b*, 5*b* of the ink bag 5. In other words, the fixing portion 7*a*2 has a cross sectional area as measured in the widthwise direction of the ink bag 5 (as measured in the Y-directions), which cross sectional area gradually decreases toward the widthwise opposite ends 5*b*, 5*b* of the ink bag 5. According to this arrangement, the fixing portion 7*a*2 can be easily welded to the opening 5*a* of the ink bag 5, for thereby improving the fluid-tightness of the ink bag 5.

As shown in FIG. 2B, the extending portion 7*b* is formed adjacent to the fixing portion 7*a*2 so as to extend therefrom into the interior space of the ink bag 5. The extending portion 7*b* has, at one of opposite ends thereof at which the extending portion is adjacent to the fixing portion 7*a*2, a thickness equal to that of the fixing portion 7*a*2 as shown in FIG. 2C, and a dimension as measured in the Y-directions equal to that of the fixing portion 7*a*2 as shown in FIG. 2B. As shown in FIG. 2C, the thickness of the extending portion 7*b* gradually decreases in a direction from one of the lengthwise opposite ends of the ink bag 5 at which the opening 5*a* is provided, toward the other of the lengthwise opposite ends 5C, in other words, in a direction of extension of the extending portion 7*b* from the fixing portion 7*a*2. The thickness of the extending portion 7*b* gradually decreases also in the Y-directions (i.e., toward the widthwise opposite ends 5*b*, 5*b* of the ink bag 5), as shown in FIG. 2A. Further, the above-indicated dimension of the extending portion 7*b* as measured in the Y-directions gradually decreases in the direction of extension of the extending portion 7*b*, as shown in FIG. 2B. The dimension of the extending portion 7*b* as measured in the Y-directions is larger than a dimension thereof as measured in the Z-direction as shown in FIG. 2D and a dimension thereof as measured in the X-direction as shown in FIG. 2B. Thus, the cross sectional area of the extending portion 7*b* gradually decreases in the direction from one of the lengthwise opposite ends of the ink bag 5 toward the other of the lengthwise opposite ends 5C and in the direction toward the widthwise opposite ends 5*b*, 5*b* of the ink bag 5. The cross sectional areas of the fixing portion 7*a*2 and the extending portion 7*b* decrease, toward the widthwise opposite ends 5*b*, 5*b* at the same rate at the connection of the two portions 7*a*2, 7*b*. The extending portion 7*b* has, at one of opposite ends thereof remote from the fixing portion 7*a*2, an opening 6*d* through which the ink in the ink bag 5 flows into the spout 7.

The extending portion 7*b* is symmetrical with respect to a plane which is perpendicular to a plane of FIG. 2B and which includes the lengthwise centerline of the extending portion 7*b* at the connection with the fixing portion 7*a*2. Further, as shown in FIG. 2D, the extending portion 7*b* is symmetrical with respect to a plane which is perpendicular to a plane of FIG. 2D and which includes the centerline in the direction of thickness of the extending portion 7*b* at the connection with the fixing portion 7*a*2, in other words, with respect to a connected or welded surface at which the two sheets of the ink bag 5 are connected or welded together.

As shown in FIG. 2C, the passage 6 formed in the spout 7 includes the above-described outer end portion 6*c* in which the plug 8 is fitted and which is formed through the protruding portion 7*a*1, an intermediate portion 6*a* formed through the fixing portion 7*a*2, an inner end portion 6*b* formed through the extending portion 7*b*, and the opening 6*d* which is open in the ink bag 5.

The outer end portion 6*c* of the passage 6 is open in the exterior space at one of its opposite ends and has a diameter slightly smaller than that of the plug 8. The passage 6 is fluid-tightly closed by the plug 8 which is press-fitted in the outer end portion 6*c*.

The intermediate portion 6*a* of the passage 6 has a cross sectional area which is smaller than that of the outer end portion 6*c*. When the plug 8 fitted in the outer end portion 6*c* is pieced with a connecting member of the hollow ink-extracting needle, the intermediate portion 6*a* prevents a displacement of the plug 8 toward the interior space of the ink bag 5.

The inner end portion 6*b* of the passage 6 formed in the extending portion 7*b* of the spout 7 has a cross sectional area which is smaller than that of the intermediate portion 6*a* formed in the fixing portion 7*a*2. Accordingly, the cross sectional area of the passage 6 is made smaller in the extending portion 7*b* whose thickness decreases in the direction of extension thereof, than in the fixing portion 7*a*2. Thus, the present arrangement makes it possible to reduce the thickness of the extending portion 7*b* at its leading end (at the opening 6*d*).

When the plug 8 fitted in the outer end portion 6*c* of the passage 6 is pierced with the connecting member of the hollow ink-extracting needle, the ink in the ink bag 5 of the ink package 2 is supplied to the ink-jet printing head. As the ink in the ink bag 5 is delivered therefrom, in other words, with a decrease in the amount of the ink in the ink bag 5, the two sheets which constitute the ink bag 5 are deformed in a direction toward each other, and finally, the two sheets are brought into close contact with each other.

When the two sheets of the ink bag 5 contact each other as described above, the ink would remain in the vicinity of the fixing portion 7*a*2 unless the spout 7 had the extending portion 7*b* since the two sheets do not contact each other in the vicinity of the fixing portion 7*a*2 due to the thickness thereof, as described in the BACKGROUND OF THE INVENTION. In the present embodiment, however, the spout 7 includes the extending portion 7*b* whose configuration substantially corresponds to that of a space of a non-contact portion of the ink bag 5 in which the two sheets do not contact each other and in which the ink remains unless the extending portion is not provided, in a state in which the amount of ink in the ink bag 5 is reduced to a predetermined minimum value after the ink has been used under an ordinary recommended condition. In other words, the extending portion 7*b* fills the space of the above-indicated non-contact portion of the ink bag 5 in which the ink would remain if the extending portion 7*b* were not provided. According to the present embodiment, in the final contracted state of the ink bag 5 as a result of the decrease in the amount of the ink, the two sheets are held in close contact with the outer surface of the extending portion 7*b*, as shown in FIG. 2C, at a portion of the ink bag 5 located adjacent to the fixing portion 7*a*2, in other words, at a portion of the ink bag 5 corresponding to the above-indicated non-contact portion, while the two sheets are held in close contact with each other at the other portion of the ink bag 5 which corresponds to the contact portion, whereby the amount of the ink which remains in the ink bag 5 without being used is effectively decreased.

The extending portion 7*b* is formed such that the thickness and the width (the dimension as measured in the Y directions) gradually or smoothly change as described above, so that the two sheets of the ink bag 5 closely contact the extending portion 7*b* along its surface in the final contracted state of the ink bag 5. If the extending portion 7*b* had recesses, protrusions or steps on its surface, it would be difficult for the two sheets of the ink bag 5 to be held in close contact with the extending portion, undesirably forming clearance or spacing between the two sheets of the ink bag 5 and the surface of the extending portion 7*b* on which the recesses, protrusions or steps are formed. In this case, the ink undesirably remains in the clearance. In the extending portion 7*b* whose thickness and width gradually change, the clearance is effectively prevented from being formed between the extending portion and the ink bag 5, for thereby preventing the ink from being stored in the clearance.

The provision of the extending portion 7*b* constructed as described above is effective to reduce the interior space in the ink bag 5 in which the ink remains unless the extending portion 7*b* is provided, in the final contracted state of the ink bag 5. Accordingly, the ink in the ink bag 5 can be used with high efficiency.

Figures 3A, 3B, 3C:
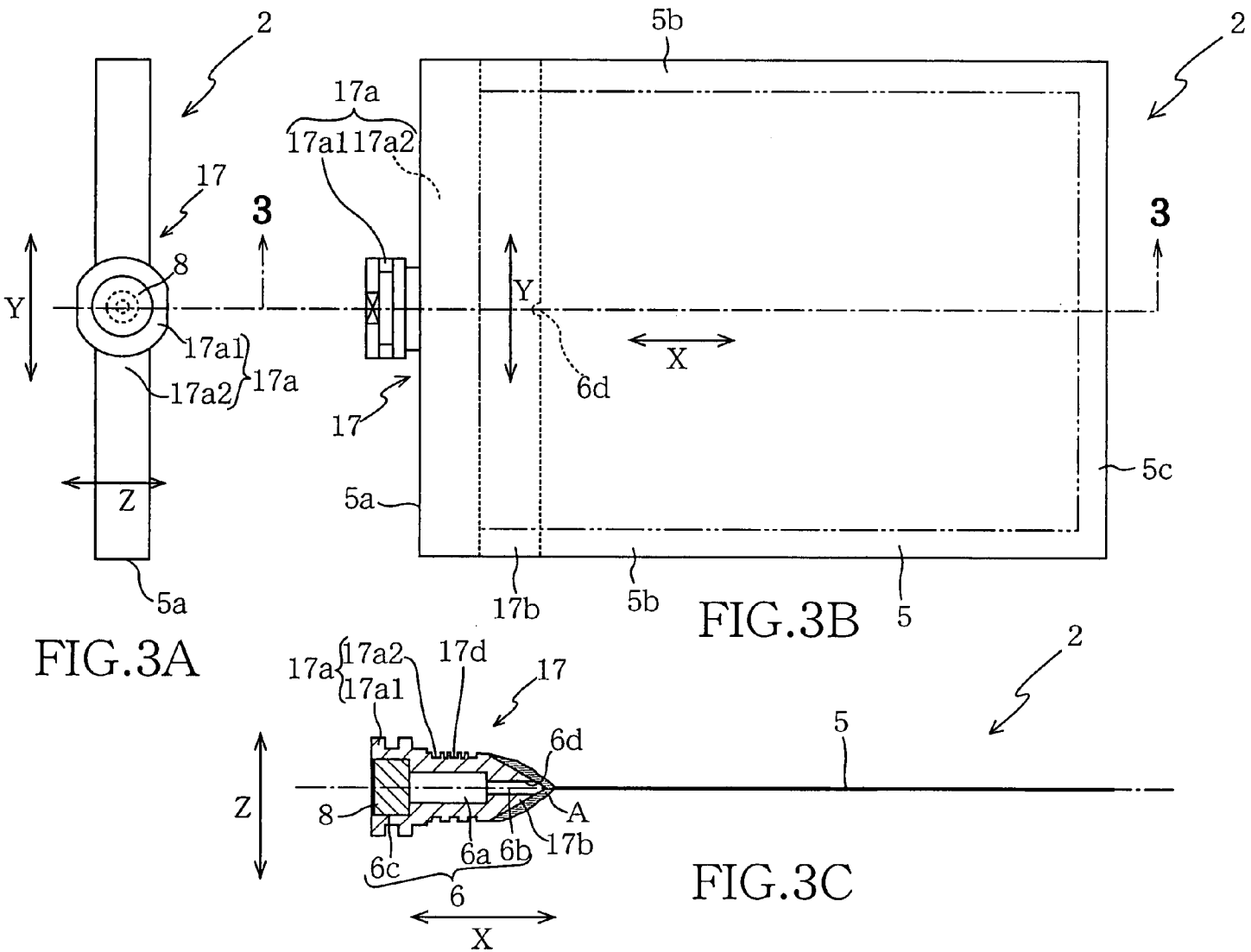

Referring next to FIGS. 3A–3C, there will be explained another ink package 2 constructed according to a second embodiment of the invention. The ink package 2 of the second embodiment includes a spout 17 different from the spout 7 of the ink package 2 of the illustrated first embodiment. In this second embodiment, the same reference numerals as used in the first embodiment are used to identify the corresponding components, and a detailed explanation of which is dispensed with.

FIGS. 3A–3C are views for explaining the ink package 2 of the second embodiment. FIG. 3A is a front elevational view of the ink package 2, as seen in a direction in which the spout 17 is inserted into the ink bag 5. FIG. 3B is a side elevational view, and FIG. 3C is an elevational view in cross section taken along line 3—3 of FIG. 3B., The ink package 2 shown in FIGS. 3A–3C is in a state in which the ink in the ink bag 5 has been substantially consumed, in other words, in a final contracted state of the ink bag 5. The dimension of the spout 17 as measured in a "Z"-direction shown in FIGS. 3A and 3C (in which the two sheets of the ink bag 5 are opposed to each other) is hereinafter referred to a thickness of the spout 17.

Described more specifically, like the spout 7 of the ink bag 2 of the first embodiment, the spout 17 includes a proximal portion 17*a* and an extending portion 17*b* which extends from the proximal portion 17*a* toward the interior space of the ink bag 5, i.e., in an "X"-direction shown in FIG. 3B. Like the spout 7, the spout 17 has a passage 6 which is formed therethrough and which is similar to the passage 6 of the spout 7. The plug 8 is fitted in one of opposite end portions of the passage 6 of the spout 17, i.e., the outer end portion 6*c* of the passage 6, as shown in FIG. 3C.

As shown in FIG. 3B, the proximal portion 17*a* of the spout 17 includes a protruding portion 17*a*1 which is similar to the protruding portion 7*a*1 of the spout 7 of the first embodiment, and a fixing portion 17*a*2 which is fixed to the inner surface of the ink bag 5 at one of the lengthwise opposite ends of the ink bag 5 at which the opening 5*a* is provided.

The fixing portion 17*a*2 is formed adjacent to the protruding portion 17*a*1 and is a rectangular parallelopiped. On the opposite major surfaces of the fixing portion 17*a*2 as seen in the direction of thickness thereof, there are formed ribs 17*d* by which the fixing portion 17*a*2 is welded and fixed to the inner surface of the opening 5*a* of the ink bag 5. As shown in FIGS. 3A and 3B, the fixing portion 17*a*2 has a dimension as measured in a "Y"-direction equal to the dimension of the opening 5*a* of the ink bag 5, i.e., the width of the ink bag 5 as measured in the Y direction. The thickness of the fixing portion 17*a*2 is constant in the Y direction, as shown in FIG. 3A.

As shown in FIGS. 3B and 3C, the extending portion 17*b* is formed adjacent to the fixing portion 17*a*2 so as to extend therefrom into the interior space of the ink bag 5. The extending portion 17*b* has, at one of opposite ends thereof at which the extending portion 17*b* is adjacent to the fixing portion 17*a*2, a dimension as measured in the Y-direction equal to that of the fixing portion 17*a*2, and a thickness equal to that of the fixing portion 17*a*2. The dimension of the extending portion 17*b* as measured in the Y-direction is constant in the direction of extension thereof toward the interior space of the ink bag 5. Accordingly, the opposite ends of the extending portion 17*b* as seen in the Y direction are sandwiched by and interposed between the two sheets of the ink bag 5 at the widthwise opposite ends 5*b*, 5*b* of the ink bag 5, so that the extending portion 17*b* is welded to the inner surface of the ink bag 5 at the opposite ends thereof as seen in the Y-direction. As shown in FIG. 3A, the thickness of the extending portion 17*b* is constant in the Y-direction. Accordingly, the thickness of the extending portion 17*b* at a given position in the X-direction (at a given distance from the opening 5*a* of the ink bag 5) is constant in the Y-direction. Further, the thickness of the extending portion 17*b* gradually decreases in the direction of extension thereof toward the interior space of the ink bag 5, i.e., in the X-direction, as shown in FIG. 3C. In this arrangement, the two sheets of the ink bag 5 are held in close contact with each other with high stability at longitudinal peripheral edges thereof even if the opposite ends of the extending portion 17*b* as seen in the Y direction are sandwiched by the two sheets of the ink bag 5 at the widthwise opposite ends 5*b*, 5*b* thereof as described above.

In the ink package 2 of the second embodiment wherein the dimension of the fixing portion 17*a*2 as seen in the Y-direction is equal to that of the opening 5*a* of the ink bag 5, the interior space A of the ink bag 5 formed in a final contracted state of the ink bag 5 has a configuration which converges in the X-direction. The configuration of the extending portion 17*b* whose thickness gradually decreases in the X-direction substantially corresponds to the configuration of the interior space of the ink bag 5. Accordingly, the provision of the extending portion 17*b* constructed as described above is effective to reduce the interior space in the ink bag 5 in which the ink remains unless the extending portion is provided, in the final contracted state of the ink bag 105.

In the ink package 2 according to the illustrated first embodiment, the extending portion 7*b* of the spout 7 has a cross sectional area which gradually decreases not only in the direction from one of opposite ends of the ink bag 5 at which the opening 5*a* is provided, toward the other end 5*c* (i.e., in the X-direction), but also in opposite two directions toward the widthwise opposite ends 5*b*, 5*b* of the ink bag 5 (i.e., in the Y-directions). According to this arrangement, the interior space in the ink bag 5 in which the ink remains in the final contracted state of the ink bag 5 if the extending portion 7*b* is not provided can be reduced not only in the direction from one of opposite end of the ink bag 5 toward the other end 5*c* (in the X-direction), but also in the above-indicated opposite two directions (in the Y-directions), so that the ink in the ink bag 5 can be used with high efficiency.

In the ink package 2 according to the illustrated first and second embodiments, the two sheets of the ink bag 5 are connected to each other at peripheral edges thereof, and the extending portion 7*b*, 17*b* is symmetrical with respect to a plane including a connected surface at which the two sheets are connected. In this arrangement, the configuration of the extending portion 7*b*, 17*b* substantially corresponds to that of the interior space in the ink bag 5 in its contracted state, which interior space is also symmetrical with respect to the above-indicated plane including the connected surface at which the two sheets of the ink bag 5 are connected together. Therefore, the interior space in which the ink remains unless the extending portion 7*b*, 17*b* is provided can be advantageously reduced by the extending portion 7*b*, 17*b* having the relatively simple structure as described above.

In the ink package 2 according to the illustrated first and second embodiments, the extending portion 7*b*, 17*b* has, at one of opposite ends thereof at which the extending portion is adjacent to the fixing portion 7*a*2, 17*a*2, the dimension as measured in the Y-directions, which dimension is larger than the dimension thereof as measured in the X-direction and the dimension as measured in the Z-direction in which the two sheets are opposed to each other. The extending portion 7*b*, 17*b* according to this arrangement is formed into a generally flat shape, so that the interior space in the ink bag 5 in which the ink remains unless the extending portion is not provided, in the contracted state of the ink bag 5 can be effectively reduced.

In the ink package according to the illustrated first and second embodiments, the passage 6 formed through the fixing portion 7*a*2, 17*a*2 and the extending portion 7*b*, 17*b* has a larger cross sectional area in the fixing portion than in the extending portion. This arrangement makes it possible to sufficiently reduce the thickness of the extending portion at its leading end, for thereby effectively reducing the amount of the ink remaining in the ink bag 5 in its contracted state.

The ink package whose spout includes the extending portion constructed according to the illustrated first and second embodiments may be used together with an ink supply apparatus in the form of a printer, for instance, which has a function of detecting ink in the ink package. Where the ink package is installed on such an ink supply apparatus, the structure of the spout serving as the ink delivering portion is modified such that the near empty state of the ink package can be detected. The structure of the ink package which is constructed according to a third embodiment of the invention and which is arranged such that the near empty state is detected will be explained in greater detail.

Figure 4:
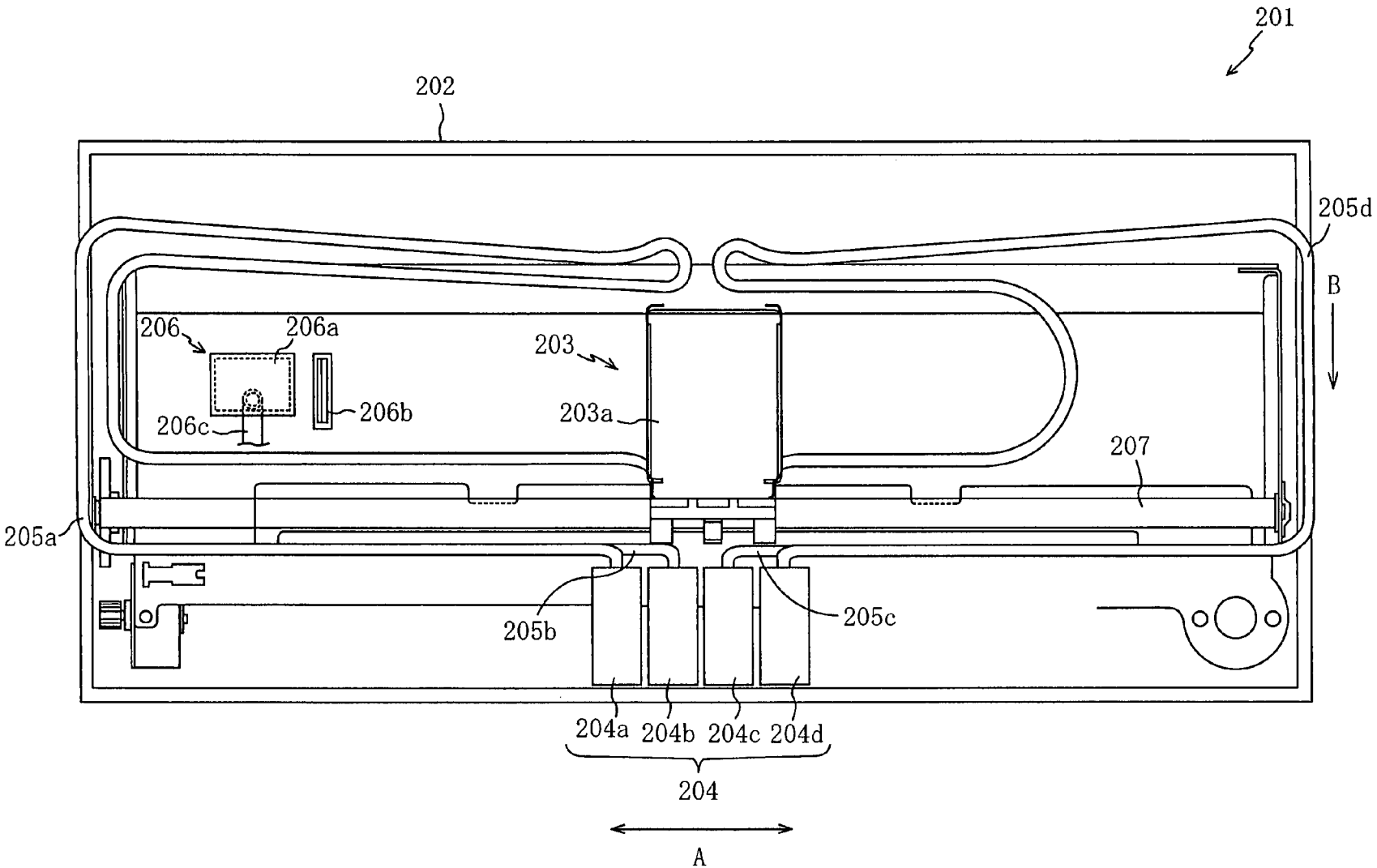
FIG. 4 is a front view showing an ink-jet printer with its cover being removed, the ink-jet printer being constructed according to the present invention.
Figure 5:
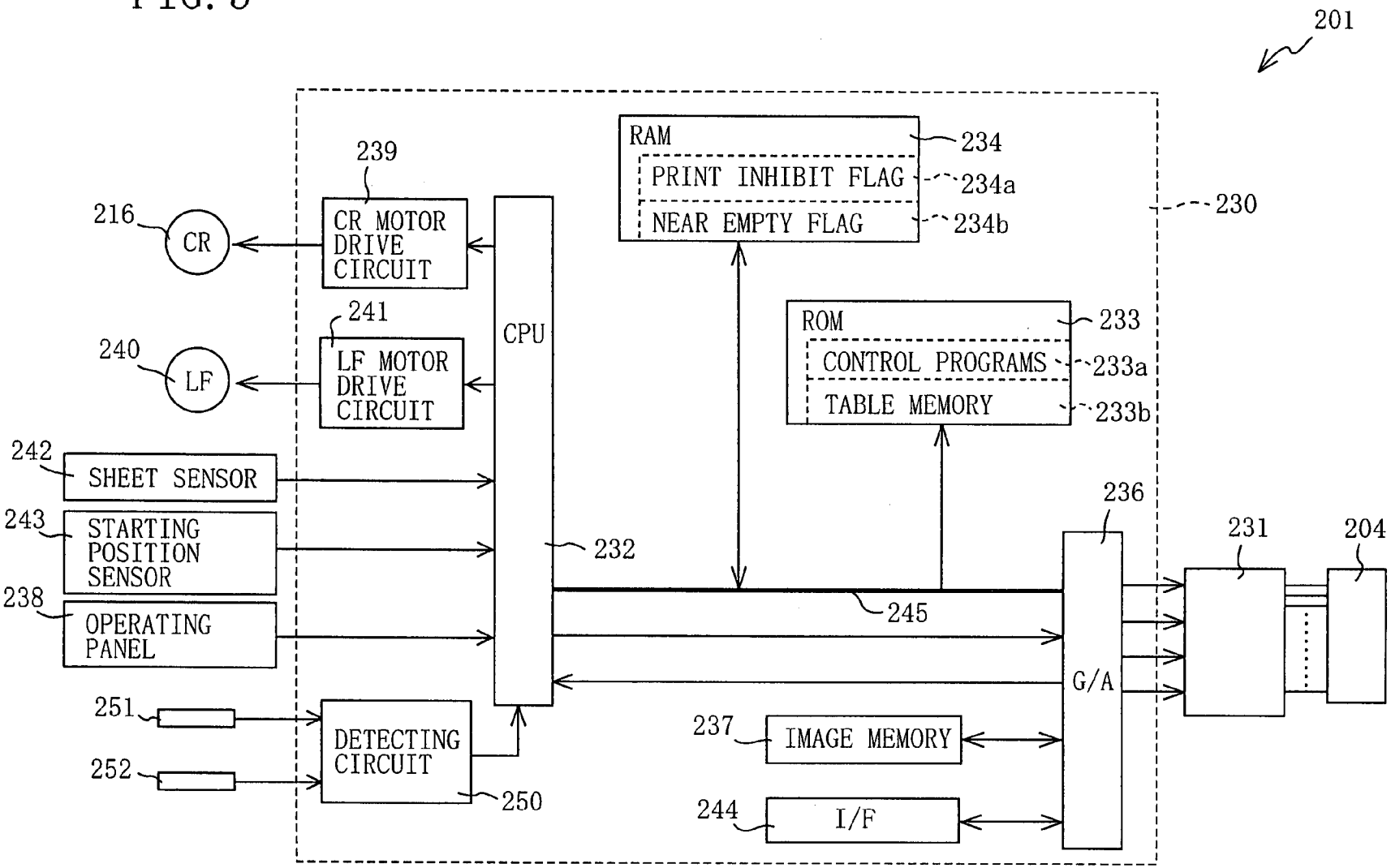
FIG. 5 is a block diagram schematically showing an electric circuitry of the ink-jet printer of FIG. 4.

Referring to FIGS. 4 and 5, there will be explained a structure of the ink supply apparatus in the form of an ink-jet printer which has a function of detecting ink in the ink package constructed according to the third embodiment which will be described. As shown in FIG. 4, the ink-jet printer generally indicated at 201 includes a main body 202 having a substantially box-like shape and formed of a fire-resistant plastic, a head unit 203 removably installed on the upper portion of the main body 202, an ink supply portion 204 (divided into mutually independent four ink supply portions 204*a*–204*d*), tubes 205*a*–205*d* through which the head unit 203 is held in communication with the ink supply portions 204*a*–204*d*, a purge device 206, and a guide rod 207.

The head unit 203 is mounted on a carriage 203*a*, and has four groups of nozzles respectively adapted to eject different colors of inks, i.e., black, yellow, cyan, and magenta. As known in the art, the carriage 203*a* is arranged to be movable by a belt driven by a carriage (CR) motor 216 (FIG. 5) via a pulley, along the guide rod 207 in a direction as indicated by "A" in FIG. 4, which direction is perpendicular to a sheet feeding direction in which a recording medium or sheet is fed.

The ink supply portion 204 is disposed below the head unit 203 as seen in a direction of gravity (as indicated by "B" in FIG. 4) and includes the four mutually independent ink supply portions 204*a*–204*d* which are arranged in the direction of movement of the carriage 203*a* and which fluid-tightly store the inks of different colors, i.e., black, yellow, cyan, and magenta, respectively. The inks of different colors stored in the respective ink supply portions 204*a*–204*d* are supplied to the respective four groups of nozzles of the head unit 203 through the respective four tubes 205*a*–205*d*.

At one of opposite end portions of the main body 202 (the left end as seen in FIG. 4), the purge device 206 for performing a purging operation is disposed. The purge device 206 includes a suction cap 206*a* which closes the nozzles of the head unit 203, a wiper 206*b* for wiping the surfaces of the nozzles, a suction pump (not shown) for inhaling the ink from the suction cap 206*a* via a discharge tube 206*c*.

Referring next to FIG. 5, there is shown a block diagram schematically indicating an electric circuitry of the ink-jet printer 201. A control device for controlling the ink-jet printer 201 includes a printer control circuit board 230 and a carriage circuit board 231 mounted on the carriage 203*a*. The printer control circuit board 230 is mounted with a microcomputer (CPU) 232 composed of a single chip, a ROM 233 which stores various control programs to be executed by the CPU 232 and fixed value data, a RAM 234 which is a memory for temporarily storing various data, an image memory 237, and a gate array (G/A) 236.

The CPU 232 executes various processing operations according to the control programs pre-stored in the ROM 233. The CPU 232 generates a print timing signal and a reset signal, and transmits the generated signals to the G/A 236 described below. To the CPU 232, there are connected an operating panel 238 through which a user gives a command such as printing, a CR motor drive circuit 239 for driving the CR motor 216 to move the carriage 203*a*, an LF motor drive circuit 241 for driving a feed motor (LF motor) 240 to feed the recording medium or print sheet, a detecting circuit 250 for detecting a resistance value between a first electrode 251 serving as a hollow ink-extracting needle and a second electrode 252, the resistance value being used to determine the near empty state, a sheet sensor 242 which detects a leading edge of the recording medium or print sheet, a starting position sensor 243 which detects a starting position of the carriage 203*a*, etc. Each of the devices connected to the CPU 232 is controlled by the CPU 232.

The ROM 233 stores control programs 233*a* such as a program for executing a processing operation (not shown) to determine a remaining amount of ink stored in the ink supply portion 4, and a table memory 233*b* which stores data used for judging the near empty state in the ink supply portion 4, in other words, data representative conditions used for judging the near empty state, on the basis of the resistance value between the hollow needle 251 and the second electrode 252 detected by the detecting circuit 250 described below. The conditions for judging the near empty state are stored in a table indicative of a relationship between an output based on the detected resistance value and the remaining amount of ink.

The RAM 234 is a volatile rewritable memory, and has a print-inhibit flag 234*a* and a near empty flag 234*b*. The near empty flag 234*b* indicates the near empty state in the ink supply portion 4, that is, the near empty flag 234*b* indicates that the ink in the ink supply portion 4 will run out in the near future, more specifically, the ink in the ink supply portion 4 has been reduced to a predetermined amount which is larger, by a predetermined amount, than an empty state of the ink (in which a printing operation is impossible) or an amount of the ink in which a printing operation should be inhibited. The near empty flag 234*b* is turned on and off, on the basis of the resistance value between the hollow needle 251 and the second electrode 252 detected by the detecting circuit 250. The print-inhibit flag 234*a* is turned on for inhibiting the printing operation in a state in which the near empty flag 234*b* is on. When the ink-inhibit flag 234*a* is turned on by the CPU 232, the printing operation is inhibited.

In accordance with the print timing signal transmitted from the CPU 232 and the image data stored in the image memory 237, the G/A 236 outputs print data (drive signal) for printing an image on a recording medium based on the image data, a transfer clock that synchronizes with the print data, a latch signal, a parameter signal for generating a basic print waveform signal, and an ejection timing signal to be outputted at predetermined intervals. The G/A 236 transfers these signals to the carriage circuit board 231 mounted with the head driver.

The G/A 236 stores image data transferred from an external equipment such as a computer, via a Centronics interface (I/F) 244, in the image memory 237. The G/A 236 generates a Centronics data reception interrupt signal based on Centronics data transferred from a host computer via the I/F 244, and transfers the generated signal to the CPU 232. Signal communications between the G/A 236 and the carriage circuit board 231 are performed via a harness cable. The CPU 232 is connected to the ROM 233, RAM 234, G/A 236 via a bus line 245.

The carriage circuit board 231 drives the head unit 203 by the head driver (drive circuit) mounted on the carriage circuit board 231. The head unit 203 and the head driver are connected to each other by a flexible wiring board on which a copper-foiled wiring pattern is formed on a polyimide film having a thickness of 50–150 μm. The head driver is controlled via the G/A 236 mounted on the printer control circuit board 230, and applies a drive pulse signal having a waveform corresponding to a recording mode to each drive element, so that a predetermined amount of ink is ejected.

The detecting circuit 250 applies a voltage to the hollow needle 251 and the second electrode 252, and detects a resistance value therebetween. The output from the detecting circuit 250 based on the detected resistance value is transferred to the CPU 232. The judgment of the near empty state is made by the CPU 232 based on the output, according to the table stored in the ROM 233 indicative of the relationship between the output on the basis of the resistance value and the remaining amount of ink. In general, the resistance value is calculated by detecting the current value between the two electrodes. In view of this, the output based on the detected current value may be transferred to the CPU 232, and the remaining amount of ink may be determined based on the detected current value. In this case, the ROM 233 may store a table indicative of a relationship between the output based on the current value and the remaining amount of ink, and the judgment of the near empty state may be made according to the table.

Figure 6:
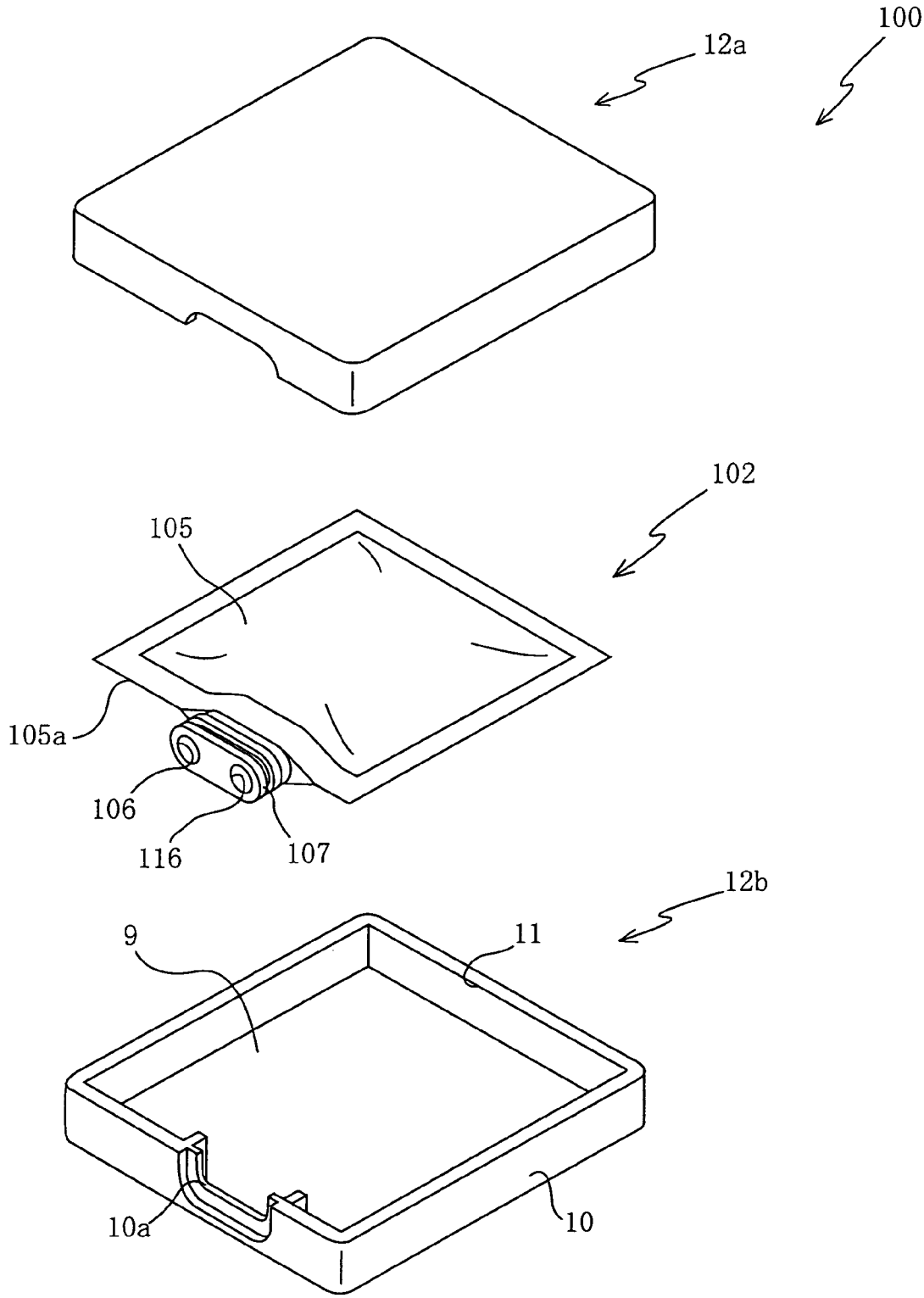
FIG. 6 is an exploded perspective view of an ink cartridge including an ink package and a casing constructed according to a third embodiment of the invention.

Referring next to FIG. 6, there will be explained the ink package which is constructed according to the third embodiment and which is used together with the above-described ink-jet printer 201 having the function of detecting ink in the ink package. FIG. 6 shows an ink cartridge 100 to be accommodated in each of the ink supply portions 204*a*–204*d* of the ink-jet printer 201. The ink cartridge 100 includes the ink package indicated at 102 whose structure is arranged such that the near empty state thereof can be detected, and a casing 12 which is a generally flat, rectangular parallelopiped. The ink cartridge 100 is removably mounted on a mounting portion 49 (FIG. 8) of the ink supply portion 204 of the ink-jet printer 201. With the ink package 102 being mounted on the mounting portion 49, the ink package 102 is pierced with the hollow ink-extracting needle 251 and the second electrode 252 as described below, so that the ink in the ink package 102 is supplied to the head unit 203 and the near empty state of the ink package 102 can be detected as described below.

The hollow ink-extracting needle 251 and the second electrode 252 are supported by the mounting portion 49 such that the needle 251 and the second electrode 252 extend therefrom and are parallel to each other. The hollow ink-extracting needle 251 is connected to a corresponding one of the tubes 205*a*–205*d* so as to supply the ink in the ink package 102 to one of the four groups of nozzles of the head unit 203. The hollow ink-extracting needle 251 is formed of an electrically conductive material, and functions also as a first electrode.

The casing 12 of the ink cartridge 100 according to the third embodiment is identical in construction with the casing 12 of the ink cartridge 1 according to the illustrated first embodiment shown in FIG. 1, and a detailed explanation of the casing 12 of the ink cartridge 100 is not given to avoid redundant description.

The ink package 102 of the ink cartridge 100 includes an ink bag 105 which fluid-tightly accommodates ink, and a spout 107 serving as an ink delivering portion through which an interior space and an exterior space of the ink bag 105 are held in communication with each other. Like the ink bag 5 of the ink package 2 of the first embodiment, the ink bag 105 of the ink package 100 of the third embodiment includes a pair of opposed walls formed from two flexible sheets each in the form of a laminar structure consisting of a plurality of films superposed on each other. The two sheets are superposed on each other and welded together along their peripheries, except a non-welded portion of the periphery of each sheet, such that the two sheets are formed into the ink bag 105 having an opening 105*a* corresponding to the above-indicated non-welded portion, as shown in FIG. 6. The ink bag 105 is filled with deaerated or degassed ink. The spout 107 is attached to the opening 105*a* of the ink bag 105. The laminar structure of each of the two sheets of the ink bag 105 is the same as described above with respect to the ink bag 5 of the illustrated first embodiment, and a detailed explanation of which is dispensed with.

The spout 107 of the ink package 102 according to the present third embodiment has a structure different from that of the spout 7 of the ink package 2 of the first embodiment, in that the spout 107 is arranged such that the near empty state of the ink package 102 can be detected.

Described more specifically by referring to FIGS. 7A–7D, the spout 107 includes a fixing portion 107*a*1 which is fixed to the opening 105*a* of the ink bag 105, a protruding portion 107*a*1 which protrudes outwardly from the fixing portion 107*a*2 in a direction away from the ink bag 105, an extending portion 107*c* which protrudes from the fixing portion 107*a*2 of the proximal portion 107*a* into the interior space of the ink bag 105, and a hollow cylindrical portion 107*b* which protrudes from the extending portion 107*c* into the interior space of the ink bag 105. The cylindrical portion 107*b* is formed of an electrically insulating material such as polypropylene. The cylindrical portion 107*b* serving as a hollow insulating member is formed integrally with the extending portion 107*c*.

Figures 7A, 7B, 7C, 7D:
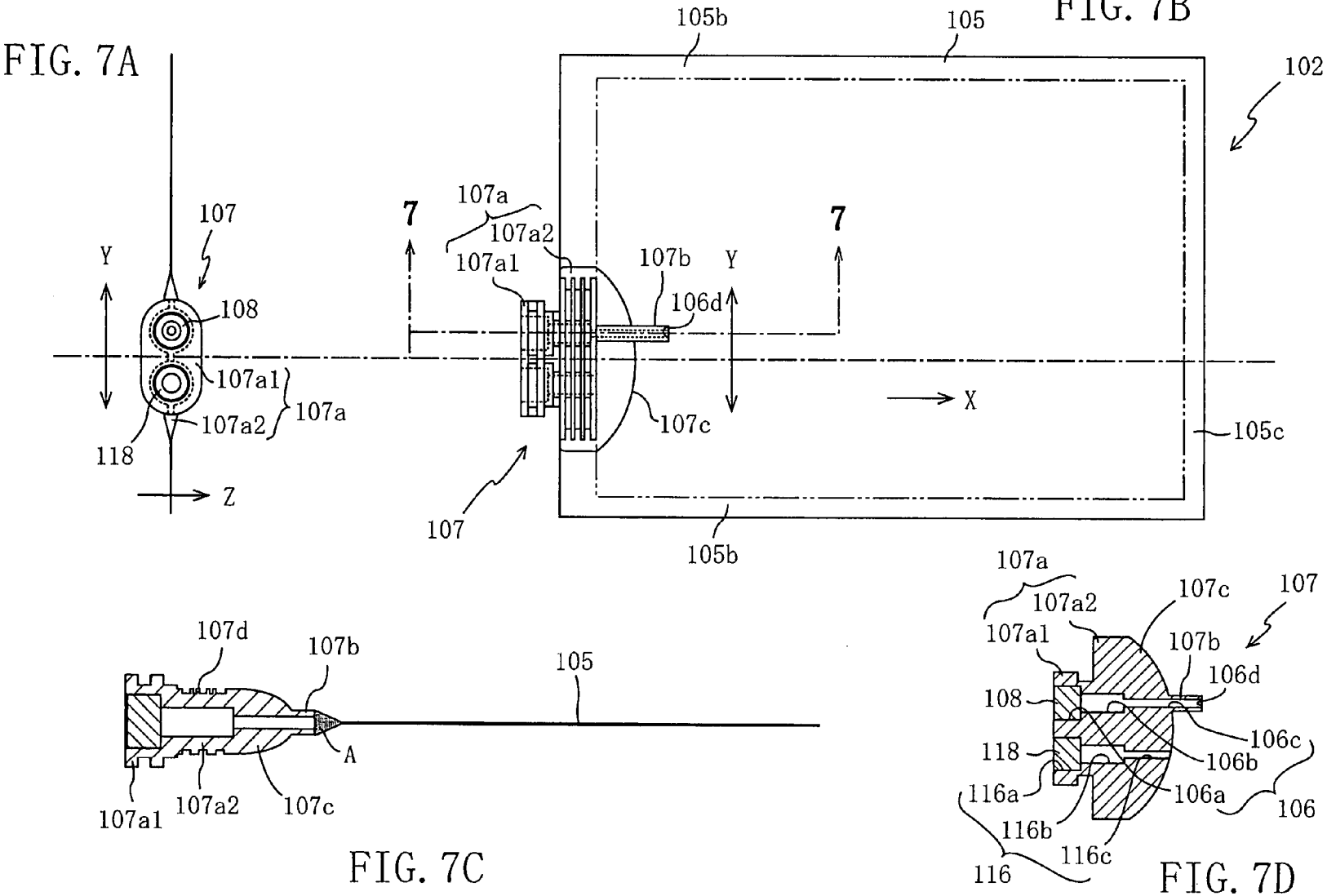

The fixing portion 107*a*2 of the spout 107 has a thickness as seen in a "Z"-direction in FIG. 7A in which the two sheets of the ink bag 105 are opposed to each other, which thickness gradually decreases in opposite two directions "Y" as indicated by two arrows in FIGS. 7A and 7B, i.e., toward the widthwise opposite ends 105*b*, 105*b* of the ink bag 105. The fixing portion 107*a*2 includes ribs 107*d* (FIG. 7C) formed on its outer circumferential surface at which the fixing portion 107*a*2 is welded to the inner layer of polypropylene of each of the two sheets of the ink bag 105, so that the fixing portion 107*a*2 is fluid-tightly fixed to the opening 105*a* of the ink bag 105.

The extending portion 107*c* of the spout 107 of the present third embodiment is identical in construction with the extending portion 7*b* of the spout 7 of the illustrated first embodiment shown in FIG. 2, except that the extending portion 107*c* is provided with the hollow cylindrical insulating member or portion 107*b*. Accordingly, a detailed explanation of the structure of the extending portion 107*c* is dispensed with to avoid redundant description.

As shown in FIGS. 7A–7D and FIG. 8, the spout 107 has two passages, i.e., a first passage 106 and a second passage 116 which are formed through the protruding portion 107*a*1, fixing portion 107*a*2, and extending portion 107*c*. The two passages 106, 116 respectively include first portions 106*a*, 116*a* formed through the protruding portion 107*a*1, second portions 106*b*, 116*b* formed through the fixing portion 107*a*2, and third portions 106*c*, 116*c* formed through the extending portion 107*c*. Owing to the provision of the hollow cylindrical portion 107*b*, the third portion 106*c* of the passage 106 extends into the cylindrical portion 107*b* and is open in the ink bag 105 at an opening 106*d*. Namely, the hollow cylindrical portion 107*b* and the passage 106 communicate with each other. The first portions 106*a*, 116*a* of the respective passages 106, 116 (one of opposite open ends of the passages 106, 116 on the side of the protruding portion 107*a*1) are fluid-tightly closed by respective plugs 108, 118 fitted thereinto. The plugs 108, 118 are formed of an elastic material such as butyl rubber, and have a high degree of elasticity or resiliency that assures a sufficient degree of fluid tightness of the ink bag 105 even after the needle 251 and the second electrode 252 that piece the respective plugs 108, 118 are removed from the plugs 108, 118.

In a state in which the amount of ink in the ink bag 105 is reduced to a predetermined minimum value after the ink has been used under an ordinary recommended condition, the ink bag 105 has a contact portion in which the two sheets of the ink bag 105 contact each other and a non-contact portion in which the two sheets do not contact each other and in which the ink would remain unless the extending portion 107*c* were provided. Like the extending portion 7*b* of the spout 7 of the illustrated first embodiment shown in FIGS. 2A–2D, the extending portion 107*c* of the spout 107 of the present third embodiment has a configuration substantially corresponds to that of a space of the non-contact portion of the ink bag 105. In other words, the extending portion 107*c* fills the space of the above-indicated non-contact portion of the ink bag 105 in which the ink would remain if the extending portion 107*c* were not provided. As in the illustrated first embodiment, the provision of the extending portion 107*c* is effective to reduce the interior space in the ink bag 105 in which the ink would remain unless the extending portion 107*c* were provided. In the present third embodiment, the cylindrical portion 107*b* formed integrally with the extending portion 107*c* extends into the interior space of the ink bag 105 beyond a boundary between the contact portion and non-contact portion. In other words, the open end of the cylindrical portion 107*b* is located in the interior space of the ink bag 105 beyond the above-indicated boundary. It is preferable that the inside and outside diameters of the cylindrical portion 107*b* are as small as possible for the purpose of minimizing an amount of the ink remaining around the cylindrical portion 107*b* when the two sheets of the ink bag 105 are brought into close contact with each other. In the present embodiment, the inside diameter of the cylindrical portion 107*b* is smaller than the diameter of the second portion 106*b* of the first passage 106 formed in the fixing portion 107*a*2.

The second passage 116 is open in the ink bag 105 at its one of opposite open ends which is on the side of its third portion 116*c*. The open ends of the first and second passage 106, 116 which are open in the ink bag 105 are spaced apart from each other in the above-indicated Y-directions and X-direction (the lengthwise direction of the ink bag 105), as seen in a plane parallel to the plane of each of the two sheets of the ink bag 105. When the two sheets of the ink bag 105 contact each other as described above, the two sheets which are held in close contact are present between the open ends of the first and second passages 106, 116.

In the ink package 100 constructed as described above, the first and second passages 106, 116 are aligned with each other on a plane perpendicular to a direction in which the two sheets of the ink bag 105 are opposed, and the passages 106, 116 are offset from a mid point of the dimension of the ink bag 105 as measured on the plane in the Y-directions. The thus constructed ink package 100 is mounted on the mounting portion 49 of the ink supply portion 204 of the ink-jet printer 201 such that the ink bag 105 is kept in a posture in which the two passage 106, 116 are aligned with each other in a vertical direction (in a direction of gravity) and the spout 107 is located at a position below the above-indicated mid point as seen in the vertical direction.

Figure 8:
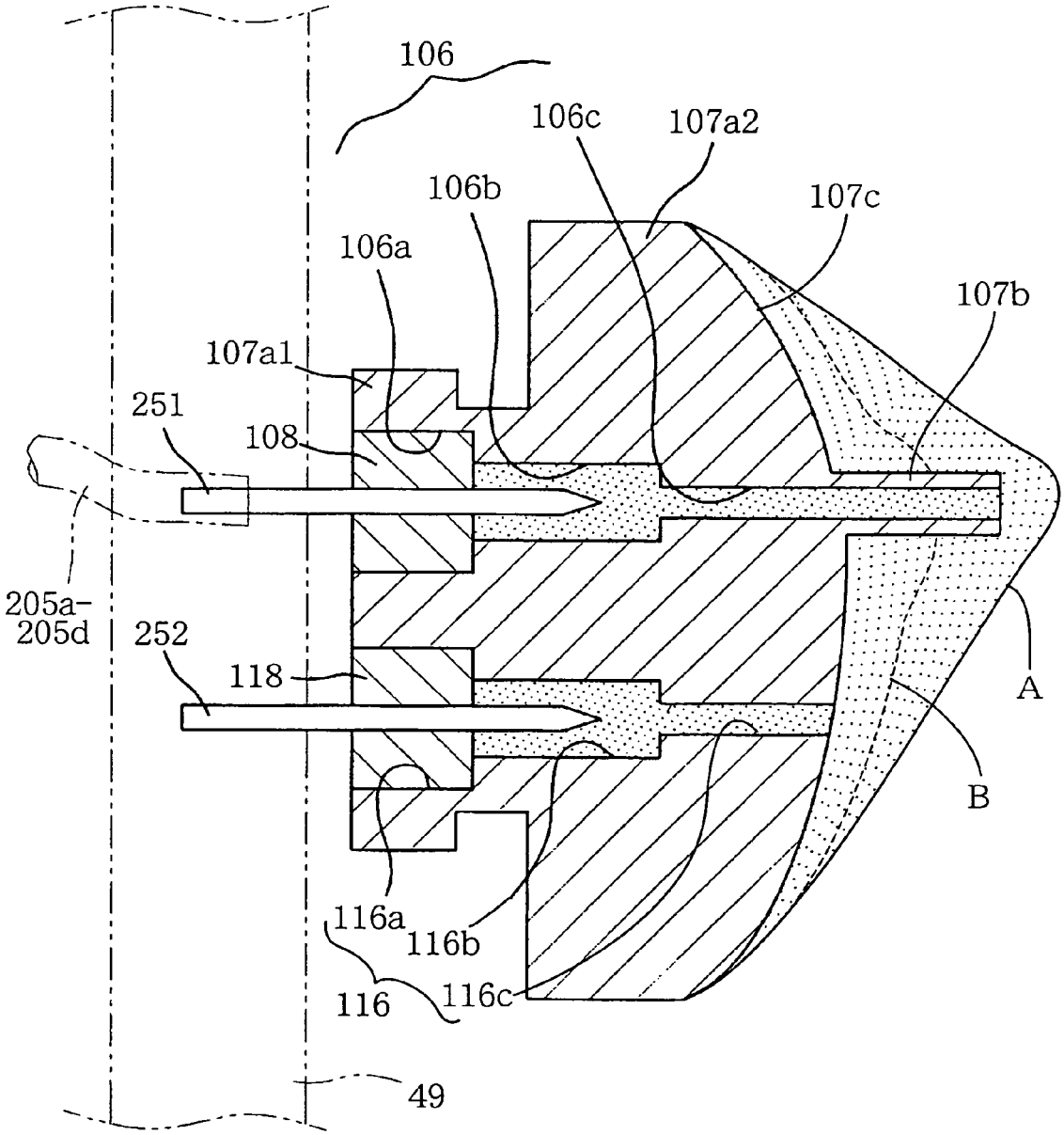
FIG. 8 is a view for explaining a state in which the ink in the ink bag decreases.

When the ink cartridge 100 is mounted on the mounting portion 49 of the ink supply portion 204 of the ink-jet printer 201, the hollow ink-extracting needle 251 pierces the plug 108 fitted in the first portion 106*a* of the passage 106, and extends into the second portion 106*b* of the passage 106 formed through the fixing portion 107*a*2, as shown in FIG. 8. Thus, the ink in the ink bag 105 is extracted by the needle 251 through the third portion 106*c* of the passage 106 and is supplied to the head unit 203. The second electrode 252 pierces the plug 118 fitted in the first portion 116*a* of the passage 116, and extends into the second portion 116*b* of the passage 116 formed in the fixing portion 107*a*2. In the present embodiment, the plugs 108, 118 which closes one of opposite open end of the respective passages 106, 116 serve as electrode supporting portions for supporting the first electrode 251 and the second electrode 252.

Between the first electrode 251 functioning as the hollow ink-extracting needle and the second electrode 252, a voltage is applied by the detecting circuit 250 so as to detect a resistance value between the two electrodes 251, 252.

A principle of detecting the near empty state of the ink package 102 constructed as described above will be explained by referring to FIG. 8. The amount of the ink in the ink bag 105 decreases as a result of the printing operation. When the amount of the ink in the ink bag 105 decreases to a level "B" indicated by a broken line in FIG. 8 from a level "A" indicated by a solid line where the ink is present between the two electrodes 251, 252 and the two electrodes 251, 252 are in a mutually conducting state, the detecting circuit 250 detects a considerably large increase in the resistance value between the two electrodes 251, 252, and the CPU 232 judges that the amount of the ink remaining in the ink bag 105 which corresponds to the output of the detecting circuit 250 based on the detected resistance value is smaller than a reference amount, and turns on the near empty flag 234*b*. After the near empty flag 234*b* has been turned on, the ink remaining in the ink bag 105 is supplied to the cylindrical portion 107*b* owing to capillary force, so that the printing operation is continued. During the continued printing operation, the number of times of ink ejection is counted. When it is determined based on the counting that a predetermined amount of the ink is used after the near empty flag 234*b* has been turned on, the CPU 232 turns on the ink inhibit flag 234*a* to stop the printing operation.

Figure 9:
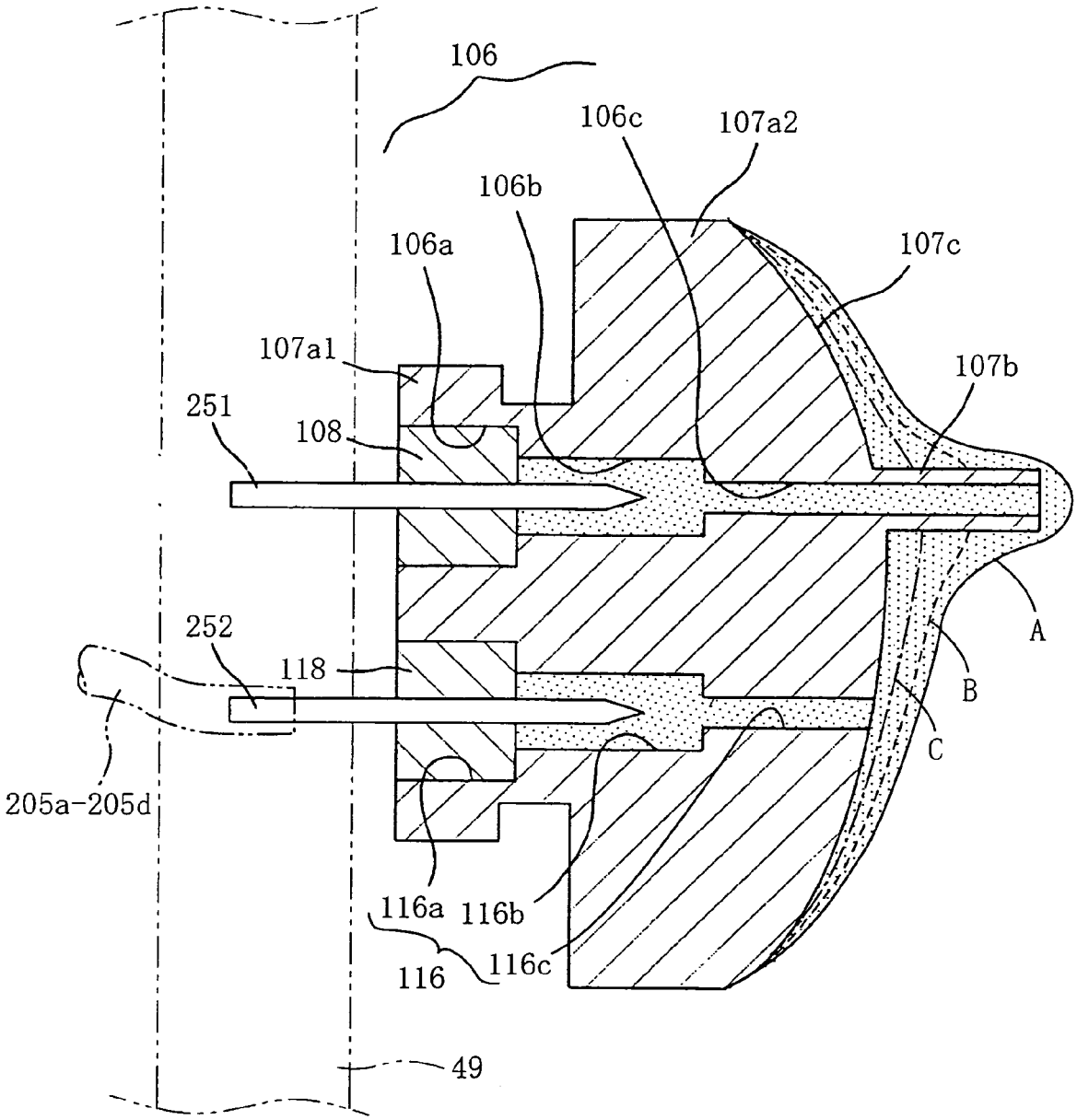
FIG. 9 is a view corresponding to FIG. 8 and showing a modified arrangement of the spout.
Figures 10A, 10B, 10C, 10D:
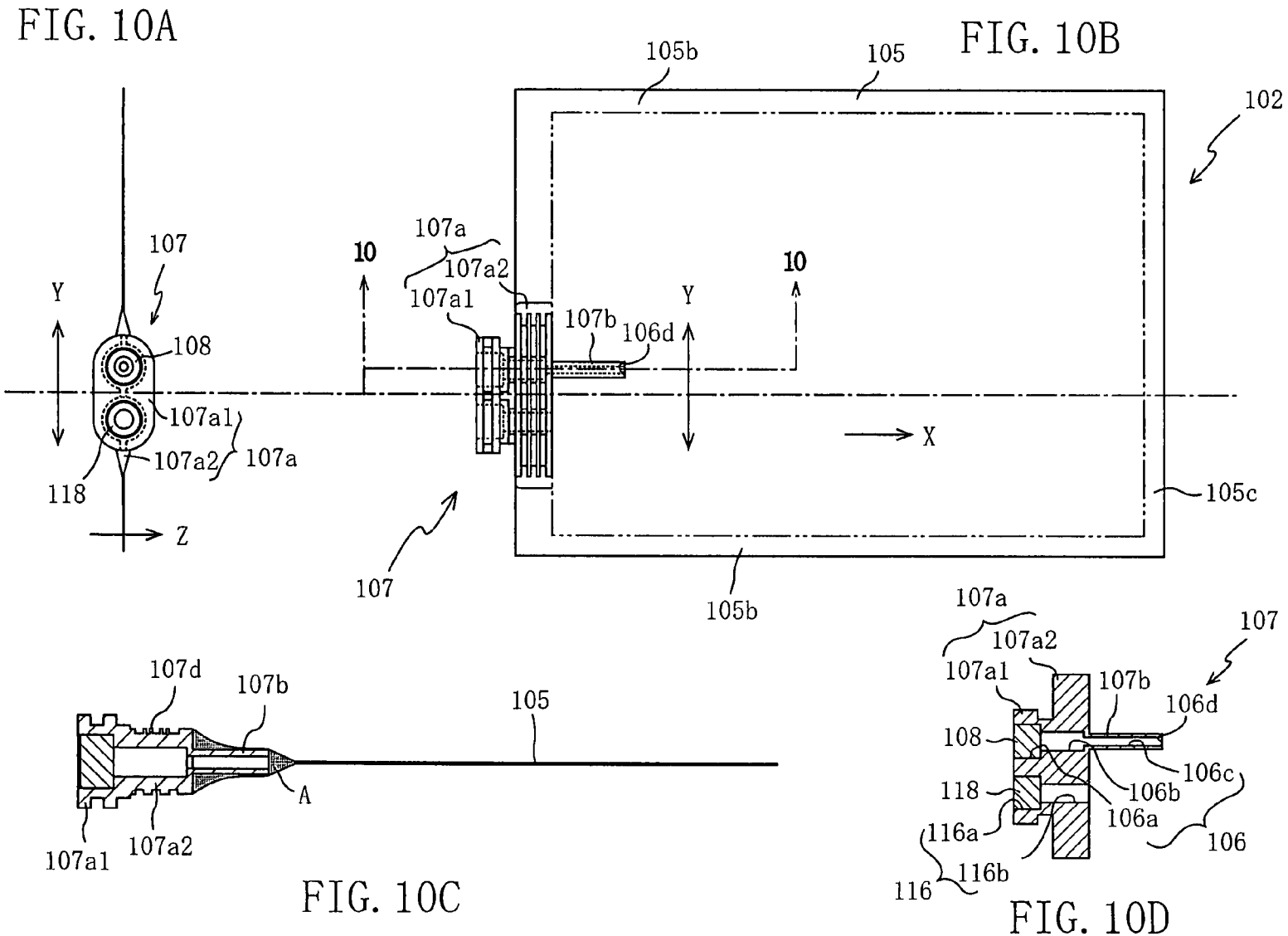
Figure 11B:
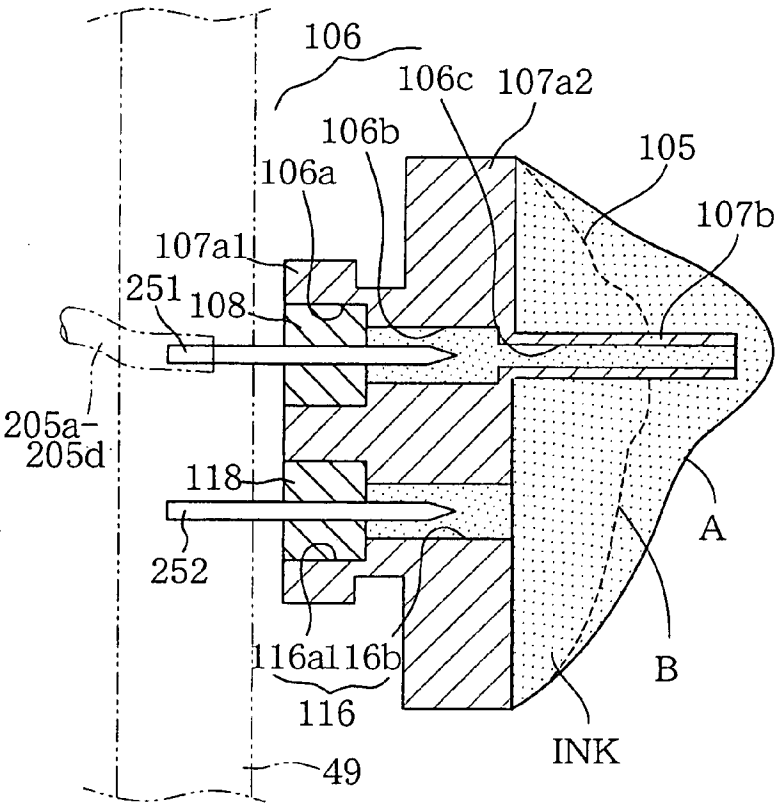
FIGS. 11A and 11B are views for explaining a state in which the ink in the ink bag decreases.
Figure 11A:
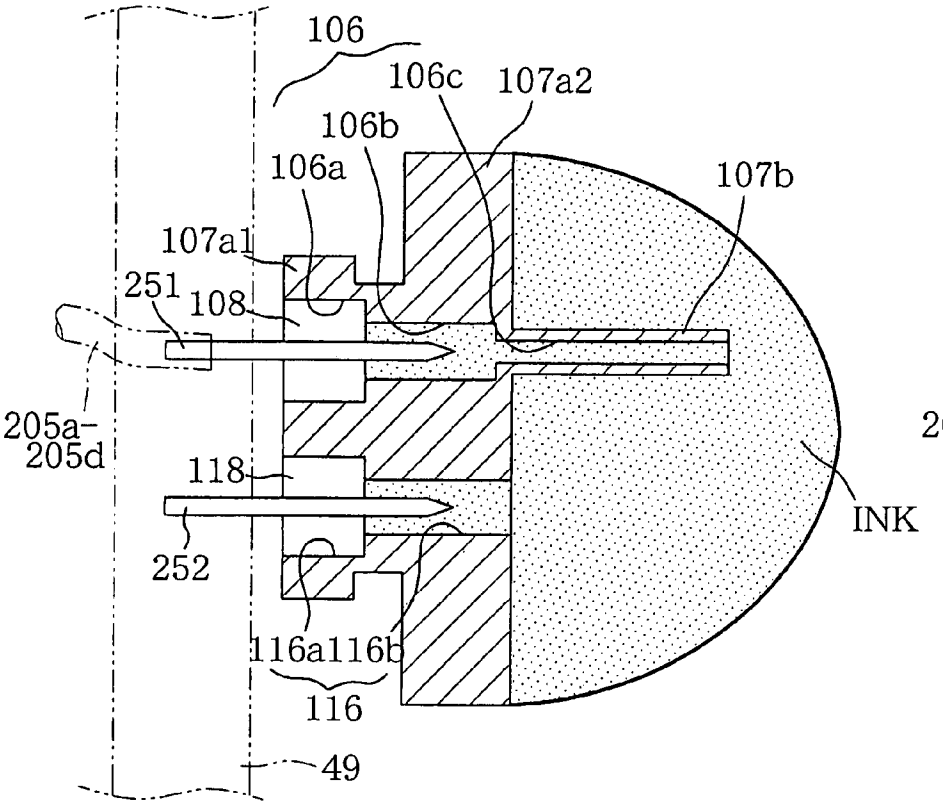

In the ink bag 102 shown in FIG. 8, the first electrode 251 functions as the hollow ink-extracting needle. The second electrode 252 may function as the ink-extracting needle, as shown in FIG. 9. In this case, the needle 252 is connected to a corresponding one of the tubes 205*a*–205*d* and extracts the ink from the ink bag 105 to supply the ink to a corresponding one of the four groups of nozzles in the head unit 203.

Where the second electrode 252 functions as the ink-extracting needle shown in FIG. 9, the near empty state of the ink package 102 is detected as follows. The amount of the ink in the ink bag 105 decreases during the printing operation. When the amount of the ink in the ink bag 105 decreases to a level "B" indicated by a broken line in FIG. 9 from a level "A" indicated by a solid line where the ink is present between the two electrodes 251, 252 and the two electrodes 251, 252 are in a mutually conducting state, the detecting circuit 250 detects a considerably large increase in the resistance value between the two electrodes 251, 252, and the CPU 232 judges that the amount of the ink remaining in the ink bag 105 which corresponds to the output of the detecting circuit 250 based on the detected resistance value is smaller than a reference amount, and turns on the near empty flag 234*b*. After the near empty flag 234*b* has been turned on, the printing operation is continued by using the ink remaining in the ink bag 105. When the amount of the ink decreases to a level "C" indicated by one-dot chain line in FIG. 9 as a result of the continued printing operation, the CPU turns on the ink inhibit flag 243*a* to inhibit the printing operation.

In the ink package 102 of the illustrated third embodiment of FIGS. 6–9, the hollow cylindrical insulating member or portion 107*b* protrudes from the extending portion 107*c*. The cylindrical portion 107*b* may protrude directly from the fixing portion 107*a*2 of the spout 107. Referring to FIGS. 10A–10D and 11A–11B, there will be next explained an ink package 102 which is constructed according to a fourth embodiment and whose spout 107 includes the hollow cylindrical portion 107*b* that protrudes directly from the fixing portion 107*a*2. The ink package 102 of the present fourth embodiment is used together with the ink-jet printer 201 as the ink supply apparatus explained above with respect to the illustrated third embodiment. In FIGS. 10A–10D and 11A–11B, the same reference numerals as used in the third embodiment of FIGS. 6–9 are used to identify the corresponding components, and a detailed explanation of which is dispensed with.

In the ink package 102 constructed according to the fourth embodiment, the hollow cylindrical insulating member or portion 107*b* protrudes from the fixing portion 107*a*2 of the spout 107 toward the interior space of the ink bag 105. As described above with respect to the third embodiment, in a state in which the amount of ink in the ink bag 105 is reduced to a predetermined minimum value after the ink has been used under the ordinary recommended condition, the ink bag 105 has the contact portion in which the two sheets of the ink bag 105 contact each other and the non-contact portion in which the two sheets do not contact and in which the ink remains. Described more specifically, in the non-contact portion of the ink bag 105 in the vicinity of the fixing portion 107*a*2 of the spout 107, the two sheets do not contact each other due to the thickness of the fixing portion 107*a*2, while the two sheets contact each other at a position of the ink bag 105 which is spaced apart from the non-contact portion by a suitable distance in a direction toward one of the lengthwise opposite ends 105*c* that is remote from the opening 105*a* and which corresponds to the contact portion. The hollow cylindrical portion 107*b* extends from the fixing portion 107*a*2 toward the interior space of the ink bag 105 beyond a boundary between the contact portion and the non-contact portion.

In the thus constructed ink package 102 of the fourth embodiment, the near empty state thereof is detected in a manner similar to that described above with respect to the ink package 102 of the third embodiment. Described more specifically by referring to FIGS. 11A and 11B, when the amount of the ink in the ink bag 105 decreases to a level "B" indicated by a broken line in FIG. 11B from a level "A" indicated by a solid line where the ink is present between the two electrodes 251, 252 and the two electrodes 251, 252 are in a mutually conducting state, the detecting circuit 250 detects a considerably large increase in the resistance value between the two electrodes 251, 252, and the CPU 232 judges that the amount of the ink remaining in the ink bag 105 which corresponds to the output of the detecting circuit 250 based on the detected resistance value is smaller than a reference amount, and turns on the near empty flag 234*b*. After the near empty flag 234*b* has been turned on, the ink remaining in the ink bag 105 is supplied to the cylindrical portion 107*b* owing to capillary force, so that the printing operation is continued. During the continued printing operation, the number of times of ink ejection is counted. When it is determined based on the counting that a predetermined amount of the ink is used after the near empty flag 234*b* has been turned on, the CPU 232 turns on the ink inhibit flag 234*a* to stop the printing operation.

In the ink package 102 of the fourth embodiment, the leading ends of the needle 251 and the second electrode 252 are located within the respective passages 106, 116, so that the leading ends do not extend from the fixing portion 107*a*2 of the spout 107 into the ink bag 105, for thereby preventing the ink bag 105 from being damaged by the needle 251 and the second electrode 252.

Figure 12B:
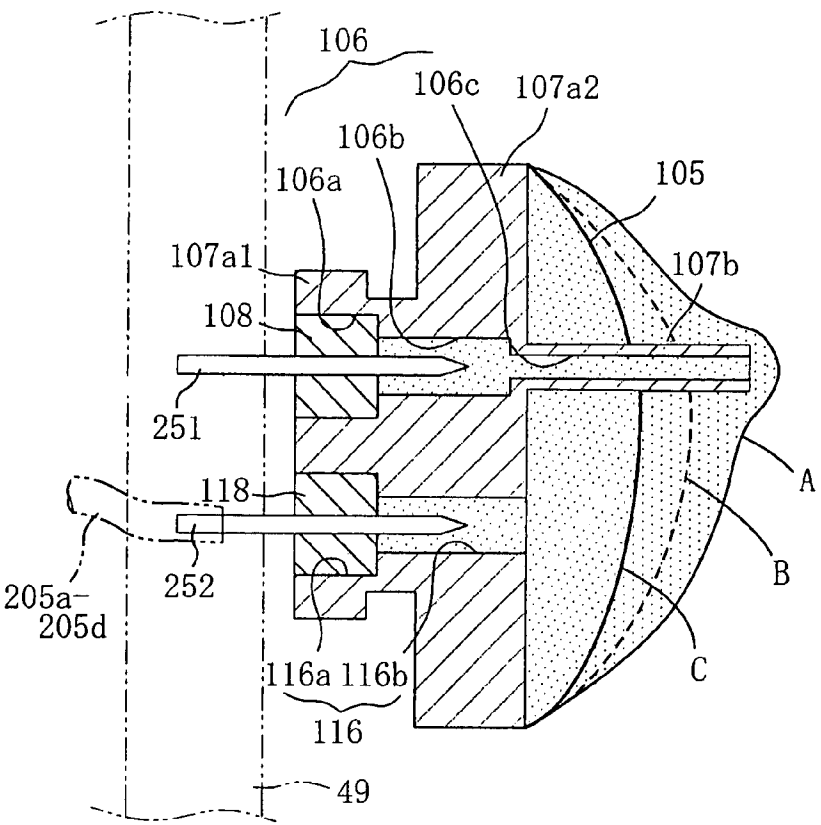
FIGS. 12A and 12B are views corresponding to FIGS. 11A and 11B and showing a modified arrangement of the spout.
Figure 12A:
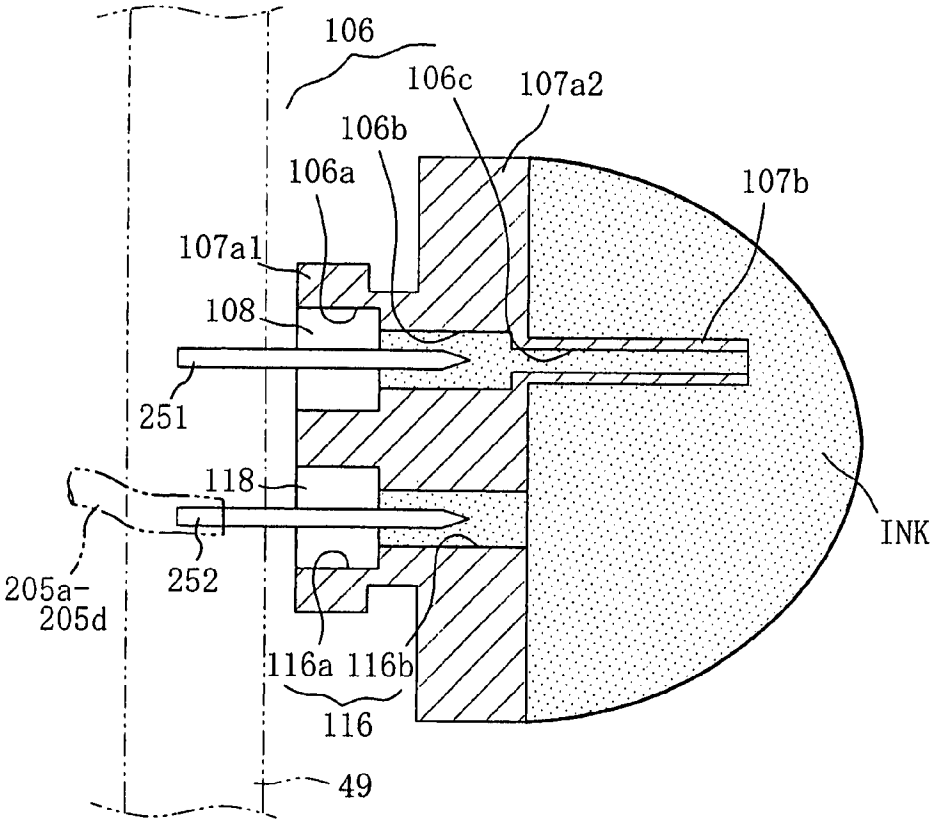

As described above with respect to the ink package 102 of the third embodiment, the ink package 102 of this fourth embodiment may be modified such that the second electrodes 252 functions as the hollow ink-extracting needle, as shown in FIGS. 12A and 12B. In this case, the near empty state of the ink package 102 is detected in a manner similar to that described above with respect to FIG. 9. Described more specifically by referring to FIGS. 12A and 12B, when the amount of the ink in the ink bag 105 decreases to a level "B" indicated by a broken line in FIG. 12B from a level "A" indicated by a solid line where the ink is present between the two electrodes 251, 252 and the two electrodes 251, 252 are in a mutually conducting state, the detecting circuit 250 detects a considerably large increase in the resistance value between the two electrodes 251, 252, and the CPU 232 judges that the amount of the ink remaining in the ink bag 105 which corresponds to the output of the detecting circuit 250 based on the detected resistance value is smaller than a reference amount, and turns on the near empty flag 234*b*. After the near empty flag 234*b* has been turned on, the printing operation is continued by using the ink remaining in the ink bag 105. When the amount of the ink decreases to a level "C" in FIG. 12B as a result of the continued printing operation, the CPU turns on the ink inhibit flag 243*a* to inhibit the printing operation.

In the illustrated third and fourth embodiments, the electrode supporting portions in the form of the plugs 108, 118 are provided at one of opposite ends of the ink bag 105, so that the pair of electrodes 251, 252 can be supported with high stability, making it possible to detect, with high accuracy, the electric characteristics, e.g., the resistance value, between the two electrodes. Accordingly, the state of the ink such as the near empty state can be detected with high stability.

In the illustrated third and fourth embodiments, the pair of electrodes 251, 252 are provided on the mounting portion 49 on which the ink cartridge 100 is removably mounted, such that the electrodes 251, 252 protrude from the mounting portion 49. According to this arrangement, when the ink cartridge 100 is mounted on the mounting portion 49, the electrodes are inserted into the ink package 102 of the ink cartridge 100, making it possible to detect the near empty state of the ink package.

In the illustrated third and fourth embodiments, one of the pair of electrodes 251, 252 functions as the hollow ink-extracting needle for extracting the ink from the ink bag 105, for thereby reducing the number of components to be used and the cost of manufacture of the apparatus.

In the illustrated third embodiment, the hollow cylindrical member (insulating member) 107*b* is formed integrally with the extending portion 107*c* while it is formed integrally with the fixing portion 107*a*2 in the illustrated fourth embodiment. These arrangements reduce number of steps of manufacturing the ink package 102 more effectively than an arrangement in which the hollow cylindrical member separately prepared from the extending portion or the fixing portion is attached thereto, thereby assuring a reduction of the cost of its manufacture.

In the illustrated third and fourth embodiments, the ink delivering portion in the form of the spout 107 includes the two passage 106, 116 through which the interior space and the exterior space of the ink package 102 communicate and into which the pair of electrodes are inserted. In this arrangement, the ink is easily extracted from the ink bag 105 through one of the two passages.

In the illustrated third and fourth embodiments, the inside diameter of the hollow cylindrical portion (insulating member) 107*b* is made smaller than that of one of the two passages 106 that communicates with the hollow cylindrical portion. In this arrangement, the size of the hollow cylindrical portion can be reduced, so that the amount of the ink remaining outside the hollow cylindrical portion can be effectively reduced, permitting the near empty state to be detected with high accuracy.

In the illustrated third and fourth embodiments, the two passages 106, 116 are aligned with each other on a plane perpendicular to a direction in which the two sheets of the ink bag 105 are opposed, and the two passages 106, 116 are offset from the mid point of the dimension of the ink bag 105 as measured on the plane in the above-indicated Y-directions. The thus constructed ink cartridge 100 is mounted on the mounting portion 49 of the ink supply portion 204 of the ink-jet printer 201 such that the ink bag 105 of the ink package 102 is kept in a posture in which the two passage 106, 116 are aligned with each other in the vertical direction (in the direction of gravity) and the spout 107 is located at a position below the above-indicated mid point as seen in the vertical direction. With the ink cartridge 100 being mounted on the mounting portion 49 as described above, the ink tends to store at the lower portion of the ink bag 105 as seen in the vertical direction owing to its self-weight when the ink is extracted from the ink bag 105 through the ink delivering portion in the form of the spout 107, so that the two sheets of the ink bag 105 begin to contact each other from the upper portion of the ink bag 105 as seen in the vertical direction. Accordingly, the ink in the ink bag 105 can be consumed with high efficiency.

The illustrated third embodiment enjoys the advantages offered by the provision of the extending portion similar to those described above with respect to the illustrated first and second embodiments.

While the preferred embodiments of the present invention have been described above, for illustrative purpose only, it is to be understood that the invention is not limited to the details of the illustrated embodiments, but may be embodied with various changes, modifications and improvements, which may occur to those skilled in the art, without departing from the spirit and scope of the invention defined in the attached claims.

For instance, in the illustrated third and fourth embodiments, one of the pair of electrodes functions as the hollow ink-extracting needle. The needle may be provided separately from the two electrodes. In this case, the spout 107 is arranged to have three passages which permit communication between the interior and exterior spaces of the ink bag 105 and into which the needle and the two electrodes are inserted, respectively. Where the spout 107 has the extending portion, the extending portion may be provided so as to correspond to at least one of the three passages, to attain the advantages of the present invention.

In the illustrated third and fourth embodiments, the first and second electrodes 251, 252 are supported by the mounting portion 49 of the ink supply portion 204 of the ink-jet printer 201, and the plugs 108, 118 functioning as the electrode supporting portions are pierced with the respective two electrodes 251, 252 when the ink cartridge 100 is mounted on the mounting portion 49. The ink package 102 may be arranged such that the ink package 102 has at least one of the two electrodes supported by the plugs 108, 118 functioning as the electrode supporting portions. In this case, the mounting portion on which the ink cartridge 100 is mounted has a terminal portion to be held in contact with the at least one of the two electrodes attached to the ink package 102.

In the illustrated third and fourth embodiments, the near empty state is judged according to the table stored in the ROM 233 based on the resistance value detected by the detecting circuit 250. The near empty state may be judged otherwise. For instance, the judgment of the near empty state may be made by the CPU 233 when the resistance value detected by the detecting circuit 250 becomes larger than a predetermined value or when the current value detected by the detecting circuit 250 becomes smaller than a predetermined value.

What is claimed is:

1. An ink package comprising:

an ink bag including a pair of flexible walls which are opposed to each other and accommodating ink; and an ink delivering portion having a passage through which an interior space and an exterior space of said ink bag are held in communication for delivering said ink in said ink bag to said exterior space, wherein said ink delivering portion includes a fixing portion which is fixed to one of two opposite ends of said ink bag, and an extending portion which is formed adjacent to said fixing portion and extends therefrom along a length of the extending portion in a first direction from said one of the two opposite ends of said ink bag into the interior space toward the other of the two opposite ends thereof, said extending portion having an end distal from the fixing portion and having a cross sectional area which gradually decreases in the first direction at least from a point on the length until the end of the extending portion.

2. The ink package according to claim 1, wherein said extending portion has a thickness which gradually decreases in said first direction.

3. The ink package according to claim 1, wherein each of said fixing portion and said extending portion has a cross sectional area that gradually decreases in opposite second directions which are perpendicular to said first direction and a third direction in which said pair of walls are opposed to each other.

4. The ink package according to claim 1, wherein said pair of flexible walls are constituted by a pair of flexible sheets which are opposed to each other and which are connected to each other at peripheral edges thereof, said extending portion being symmetrical with respect to a plane including a connected surface at which said pair of flexible sheets are connected.

5. The ink package according to claim 4, wherein said extending portion has, at one of opposite ends thereof at which said extending portion is adjacent to said fixing portion, a second dimension as measured in a second direction perpendicular to said first direction and a third direction in which said pair of flexible sheets are opposed to each other, said second dimension being larger than a first dimension thereof as measured in said first direction.

6. The ink package according to claim 5, wherein said second dimension of said extending portion is larger than a third dimension thereof as measured in said third direction.

7. The ink package according to claim 1, wherein said passage extends through said fixing portion and said extending portion, said passage having a cross sectional area in said fixing portion larger than that in said extending portion.

8. The ink package according to claim 1, wherein said ink bag has, in a state in which the amount of ink in said ink bag is reduced to a predetermined minimum value after the ink has been used under an ordinary recommended condition, a non-contact portion in which said walls do not contact each other and in which the ink remains unless said ink delivering portion has extending portion, said extending portion having a configuration which substantially corresponding to that of said non-contact portion.

9. The ink package according to claim 1, wherein said passage comprises at least two passages which extend through said fixing portion and said extending portion, said ink package further comprising a hollow insulating member which extends from said extending portion toward said interior space of said ink bag and which communicates with one of said at least two passages.

10. The ink package according to claim 9, wherein said hollow insulating member has an inside diameter smaller than that of said one of said at least two passages communicating with said hollow insulating member.

11. The ink package according to claim 9, wherein said hollow insulating member is formed integrally with said extending portion.

12. The ink package according to claim 9, wherein said ink delivering portion includes electrode supporting portions each of which closes one of opposite open ends of a corresponding one of said at least two passages on the side remote from said ink bag, said electrode supporting portions being provided for supporting a pair of electrodes.

13. The ink package according to claim 12, wherein one of said pair of electrodes is a hollow ink-extracting needle for extracting the ink in said ink bag.

14. The ink package according to claim 9, wherein said at least two passages are aligned with each other on a plane perpendicular to a direction in which said pair of flexible walls are opposed, said at least two passages being offset from a mid point of a dimension of said ink bag as measured on said plane in a direction perpendicular to said first direction.

15. An ink detecting apparatus which detects ink in an ink package that includes an ink bag accommodating ink and an ink delivering portion through which the ink in said ink bag is delivered from said ink bag, said ink detecting apparatus comprising:

a pair of electrodes provided to be held both at a first end of said ink bag to electrically conduct with the ink in said ink bag;

a hollow insulating member provided for one of said pair of electrodes to extend in a direction from the first end toward a second end of the ink bag that is opposite to the first end, such that said one of said pair of electrodes does not protrude into an interior space of said ink bag, the ink in said ink bag reaching said one of said pair of electrodes through said hollow insulating member;

an electric characteristics detecting device which detects electric characteristics between said pair of electrodes, and wherein said ink delivering portion includes a passage within which the other of said pair of electrodes is located so as not to protrude into said interior space of said ink bag, wherein the passage and the hollow insulating member are separate elements that are both held at the first end of ink bag and extend in the direction toward the second end; and wherein the one of said pair of electrodes is not within the passage, and the other of said pair of electrodes is not within the hollow insulating member.

16. The ink detecting apparatus according to claim 15, wherein said ink package is removably mounted on a mounting portion, and said pair of electrodes are attached to at least one of said ink package and said mounting portion and extend toward said ink bag in a state in which said ink package is mounted on said mounting portion.

17. The ink detecting apparatus according to claim 15, wherein said ink bag includes a pair of walls which are opposed to each other and which are flexible in a direction in which said pair of walls contact each other with a decrease in an amount of the ink in said ink bag, said ink bag having a contact portion in which said walls contact each other in a state in which the amount of ink in said ink bag is reduced to a predetermined minimum value after the ink has been used under an ordinary recommended condition, and a non-contact portion in which said walls do not contact in said state and in which the ink remains, said hollow insulating member extending in said direction from said first end toward the second end beyond a boundary between said contact portion and said non-contact portion.

18. The ink detecting apparatus according to claim 15, wherein either one of said pair of electrodes is a hollow ink-extracting needle for extracting the ink from the ink bag.

19. The ink detecting apparatus according to claim 16, wherein at least one of said pair of electrodes is attached to said ink package.

20. The ink detecting apparatus according to claim 16, wherein at least one of said pair of electrodes is attached to said mounting portion.

21. The ink detecting apparatus according to claim 15, wherein said hollow insulating member is formed integrally with said ink delivering portion.

22. The ink detecting apparatus according to claim 15, wherein said ink delivering portion further includes: another passage which is different from the passage within which the other of said pair of electrodes is located; and an electrode supporting portion which closes one of opposite open ends of said another passage on the side remote from said ink bag and which is provided for supporting said one of said pair of electrodes such that said one of said pair of electrodes is located within said another passage, said hollow insulating member communicating with said another passage.

23. The ink detecting apparatus according to claim 22, wherein said hollow insulating member has an inside diameter smaller than that of said another passage communicating with said hollow insulating member.

24. The ink detecting apparatus according to claim 15, wherein said ink delivering portion further includes another electrode supporting portion which closes one of opposite ends of the passage on the side remote from said ink bag and which is provided for supporting the other of said pair of electrodes.

25. The ink detecting apparatus according to claim 15, wherein said ink delivering portion of said ink package includes a fixing portion which is fixed to the first end of said ink bag and an extending portion which is formed adjacent to said fixing portion so as to extend therefrom into said ink bag, said extending portion having a cross sectional area which decreases in a direction from said first end toward the second end.

26. An ink package comprising:

an ink bag accommodating ink and including a pair of walls which are opposed to each other and which are flexible in a direction in which said pair of walls contact each other with a decrease in an amount of the ink in said ink bag;

an ink delivering portion which is provided at a first end of said walls and is provided for supporting a pair of electrodes such that said pair of electrodes electrically conduct with the ink in said ink bag; and a hollow insulating member provided for one of said pair of electrodes to extend in a direction from the first end toward a second end of the ink bag that is opposite to the first end, such that said one of said pair of electrodes does not protrude into an interior space of said ink bag, the ink in said ink bag reaching said one said pair of electrodes through said hollow insulating member, wherein said ink delivering portion includes a passage within which the other of said pair of electrodes is located so as not to protrude into the interior space of the ink bag, wherein the passage and the hollow insulating member are separate elements that are both held at the first end of ink bag and extend in the direction toward the second end; and wherein the one of said pair of electrodes is not within the passage, and the other of said pair of electrodes is not within the hollow insulating member.

27. The ink package according to claim 26, wherein either one of said pair of electrodes is a hollow ink-extracting needle for extracting the ink from said ink bag.

28. The ink package according to claim 26, wherein said ink bag has a contact portion in which said walls contact each other in a state in which the amount of ink in said ink bag is reduced to a predetermined minimum value after the ink has been used under an ordinary recommended condition, and a non-contact portion in which said walls do not contact in said state and in which the ink remains, said hollow insulating member extending in said direction from said first end toward the second end beyond a boundary between said contact portion and said non-contact portion.

29. The ink package according to claim 26, wherein said hollow insulating member is formed integrally with said ink delivering portion.

30. The ink package according to claim 26, wherein said ink delivering portion further includes: another passage which is different from the passage within which the other of said pair of electrodes is located; and an electrode supporting portion which closes one of opposite ends of said another passage on the side remote from said ink bag and which is provided for supporting said one of said pair of electrodes such that said one of said pair of electrodes is located within said another passage, said hollow insulating member communicating with said another passage.

31. The ink package according to claim 30, wherein said hollow insulating member has an inside diameter smaller than that of another passage communicating with said hollow insulating member.

32. The ink package according to claim 26, wherein said ink delivering portion further includes another electrode supporting portion which closes one of opposite ends of the passage on the side remote from said ink bag and which is provided for supporting the other of said pair of electrodes.

* * * * *